US011560203B2

(12) United States Patent
Yu et al.

(10) Patent No.: US 11,560,203 B2
(45) Date of Patent: Jan. 24, 2023

(54) SURGE DAMPING SYSTEMS AND PROCESSES FOR USING SAME

(71) Applicant: SOFEC, INC., Houston, TX (US)

(72) Inventors: Hao Yu, Katy, TX (US); Yonghui Liu, Houston, TX (US); Stephen Lindblade, Waller, TX (US)

(73) Assignee: SOFEC, INC., Houston, TX (US)

( * ) Notice: Subject to any disclaimer, the term of this patent is extended or adjusted under 35 U.S.C. 154(b) by 33 days.

(21) Appl. No.: 17/091,610

(22) Filed: Nov. 6, 2020

(65) Prior Publication Data

US 2021/0139108 A1 May 13, 2021

Related U.S. Application Data

(60) Provisional application No. 62/932,902, filed on Nov. 8, 2019.

(51) Int. Cl.

| | |
|---|---|
| ***B63B 21/20*** | (2006.01) |
| ***B63B 13/00*** | (2006.01) |
| ***B63B 39/00*** | (2006.01) |

(52) U.S. Cl.

CPC ..... *B63B 21/20* (2013.01); *B63B 13/00* (2013.01); *B63B 39/00* (2013.01); *B63B 2021/203* (2013.01)

(58) Field of Classification Search

CPC ..... B63B 21/507; B63B 2021/001; B63B 2021/002; B63B 2021/505; B63B 21/50

See application file for complete search history.

(56) References Cited

U.S. PATENT DOCUMENTS

| | | | |
|---|---|---|---|
| 4,088,089 | A | 5/1978 | Flory |
| 4,114,556 | A | 9/1978 | Orndorff, Jr. et al. |
| 4,119,051 | A | 10/1978 | Orndorff, Jr. |

(Continued)

FOREIGN PATENT DOCUMENTS

| | | |
|---|---|---|
| EP | 0298559 | 1/1989 |
| EP | 0337531 | 7/1992 |

(Continued)

OTHER PUBLICATIONS

Wellman Dynamics Machining and Assembly Inc. "The Most Reliable Locking Device BEAR-LOC." BEAR-LOC. York, PA. <http://www.wdmachining.com>, undated.

(Continued)

*Primary Examiner* — Anthony D Wiest

(74) *Attorney, Agent, or Firm* — Edmonds & Cmaidalka, P.C.

(57) ABSTRACT

Surge damping systems and processes for using same. In some embodiments, a system for mooring a vessel can include a mooring support structure that can include a base structure and a turntable disposed on the base structure. A vessel support structure can be disposed on the vessel. At least one extension arm can be suspended from the vessel support structure. A ballast tank can be connected to the extension arm. A uni-directional passive surge damping system can be disposed on the vessel and can include an elongated tension member connected to the ballast tank that can be configured to dampen a movement of the ballast tank by applying a tension thereto. A yoke can extend from and can be connected at a first end to the ballast tank and can include a yoke head disposed on a second end thereof that can be configured to connect to the turntable.

15 Claims, 10 Drawing Sheets

(56) References Cited

U.S. PATENT DOCUMENTS

| | | | |
|---|---|---|---|
| 4,191,256 | A | 3/1980 | Croy et al. |
| 4,516,942 | A | 5/1985 | Pedersen |
| 4,568,295 | A | 2/1986 | Poldervaart |
| 6,227,135 | B1 | 5/2001 | Pedersen |
| 6,923,225 | B2 | 8/2005 | Poldervaart et al. |
| 7,007,623 | B2 | 3/2006 | Boatman et al. |
| 8,104,417 | B1 | 1/2012 | Shivers, III et al. |
| 8,763,549 | B2 | 7/2014 | Liu et al. |
| 9,573,659 | B2 | 2/2017 | Liu et al. |
| 2001/0029879 | A1 | 10/2001 | Cottrell et al. |
| 2003/0226487 | A1 | 12/2003 | Boatman et al. |
| 2004/0094082 | A1 | 5/2004 | Boatman et al. |
| 2005/0106959 | A1 | 5/2005 | Storvoll et al. |
| 2010/0326667 | A1 | 12/2010 | Coppens |
| 2014/0014017 | A1 | 1/2014 | Balleraud et al. |
| 2014/0034137 | A1 | 2/2014 | Kelly et al. |
| 2017/0113762 | A1 | 4/2017 | Lindblade |

FOREIGN PATENT DOCUMENTS

| | | |
|---|---|---|
| EP | 1826116 | 8/2007 |
| EP | 2070812 | 6/2009 |
| EP | 2646725 | 10/2013 |
| WO | 03/076262 | 9/2003 |
| WO | 2006/065130 | 6/2006 |
| WO | 2012/123191 | 9/2012 |
| WO | 2015/055327 | 4/2015 |
| WO | 2015/126320 | 8/2015 |

OTHER PUBLICATIONS

International Search Report and Written Opinion for International Application No. PCT/US2016/058149, dated Dec. 2, 2016.

International Search Report and Written Opinion for International Application No. PCT/US2020/026572 dated Jul. 20, 2020.

International Search Report and Written Opinion for International Application No. PCT/US2020/026586 dated Jul. 22, 2020.

Third-Party Observation from EPO for European Patent Application No. 16860549.1 dated Nov. 5, 2020.

"A challenging mating operation between VLCC class FPSO and soft yoke mooring system in extremely shallow water", conference paper, Texas, USA, publication date Apr.-May 2012.

International Search Report and Written Opinion for International Application No. PCT/US2020/046803 dated Nov. 30, 2020.

International Search Report and Written Opinion for International Application No. PCT/US2020/059418 dated Mar. 23, 2021.

SURGE DAMPING SYSTEMS AND PROCESSES FOR USING SAME

CROSS-REFERENCE TO RELATED APPLICATION

This application claims priority to U.S. Provisional Patent Application No. 62/932,902, filed on Nov. 8, 2019, which is incorporated by reference herein.

BACKGROUND

Field

Embodiments described generally relate to offshore mooring systems. More particularly, such embodiments relate to surge damping systems and processes for using same.

Description of the Related Art

In the drilling, production, and transportation of offshore oil and gas, mooring systems have been used to connect floating production, storage, and offloading (FPSO) vessels, floating storage and offloading (FSO) vessels, and other floating vessels to various tower structures in the open sea. Some conventional mooring systems are permanent, meaning the connected vessel can be maintained on location even in 100-year survival environmental conditions. Such permanent mooring systems are thus dependent on a site where the severe weather can be directional. Other conventional mooring systems are disconnectable, allowing vessels to leave the field, such as to avoid severe weather events and conditions like harsh seas, typhoons, hurricanes and icebergs. Tower yoke mooring systems are a type of mooring solution that can be used in permanent or disconnectable solutions.

During severe weather events however, when there may be no time to disconnect the vessel from the tower structure, the sea states can cause extreme surge conditions on the vessel which can impose significant mooring loads on the tower yoke mooring system, for example on the mechanical components of the yoke system. The associated mooring loads need to be controlled when the vessel is moored. In areas subject to more extreme offshore conditions, it can be highly desirable to provide a tower yoke mooring system that can withstand these more extreme offshore conditions. There is a need, therefore, for improved surge damping systems and processes for using same.

SUMMARY

Surge damping systems and processes for using same are provided. In some embodiments, a system for mooring a vessel can include a mooring support structure that can include a base structure and a turntable disposed on the base structure. The turntable can be configured to at least partially rotate about the base structure. A vessel support structure can be disposed on the vessel. At least one extension arm can be suspended from the vessel support structure. A ballast tank can be connected to the at least one extension arm. The ballast tank can be configured to move back and forth below the vessel support structure. A uni-directional passive surge damping system can be disposed on the vessel. The uni-directional passive surge damping system can include an elongated tension member connected to the ballast tank. The elongated tension member can be configured to dampen a movement of the ballast tank by applying a tension to the ballast tank. A yoke can extend from and can be connected at a first end to the ballast tank. The yoke can include a yoke head disposed on a second end thereof. The yoke head can be configured to connect to the turntable.

In some embodiments, a process for mooring a floating vessel to a mooring support structure at sea can include providing a floating vessel that can include a vessel support structure disposed on the vessel. At least one extension arm can be suspended from the vessel support structure. A ballast tank can be connected to the at least one extension arm. The ballast tank can be configured to move back and forth below the vessel support structure. A uni-directional passive surge damping system can be disposed on the vessel. The uni-directional passive surge damping system can include an elongated tension member connected to the ballast tank. A yoke can extend from and can be connected at a first end to the ballast tank. The yoke can include a yoke head disposed on a second end thereof. The yoke head can be configured to connect to a turntable disposed on the mooring support structure. The process can also include locating the vessel close to the mooring support structure. The mooring support structure can include a base structure. The turntable can be disposed on the base structure. The turntable can be configured to at least partially rotate about the base structure. The process can also include connecting the yoke head to the turntable. The process can also include damping a movement of the ballast tank by applying a tension to the ballast tank with the elongated tension member as the ballast tank moves away from the vessel.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

DETAILED DESCRIPTION

Figure 1:
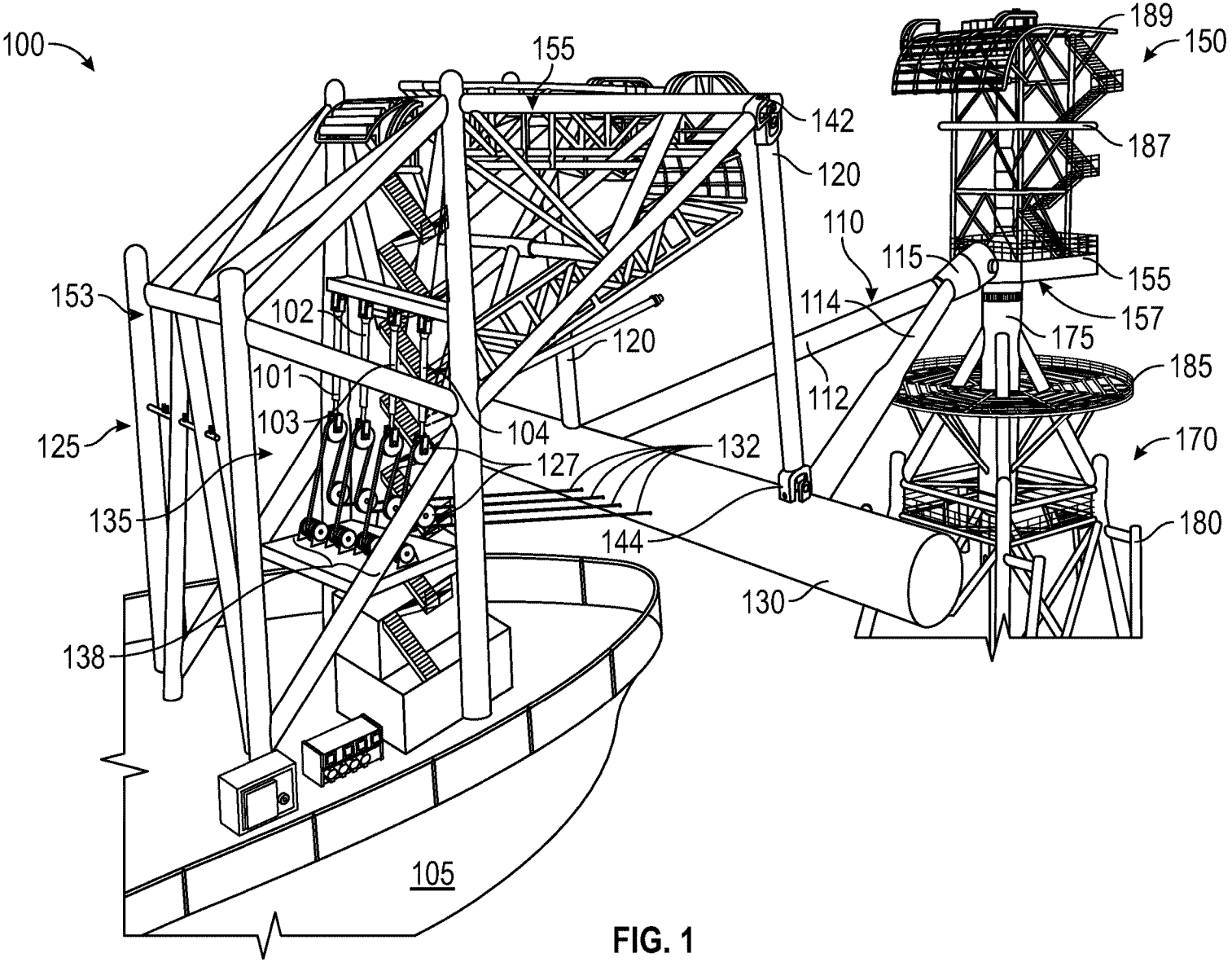
FIG. 1 depicts a schematic of an illustrative damped yoke mooring system that includes a uni-directional passive surge damping system, according to one or more embodiments.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

All numerical values in this disclosure are exact or approximate values ("about") unless otherwise specifically stated. Accordingly, various embodiments of the disclosure may deviate from the numbers, values, and ranges disclosed herein without departing from the intended scope.

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and methods of using the same may be equally effective at various angles or orientations.

FIG. 1 depicts a schematic of an illustrative damped yoke mooring system 100 that includes a uni-directional passive surge damping system 135, according to one or more embodiments. The damped yoke mooring system 100 can be located or otherwise disposed on a vessel 105. The damped yoke mooring system can be connected to a mooring support structure 150. The damped yoke mooring system 100 can include a yoke 110, a yoke head 115, a ballast tank 130, and one or more link or extension arms 120 connected to a vessel support structure 125. In some embodiments, the uni-directional passive surge damping system 135 can be disposed on the vessel support structure 125, as shown. In other embodiments, one or more components of the uni-directional passive surge damping system 135 can be disposed on the vessel support structure 125 and one or more components of the uni-directional passive surge damping system 135 can be disposed directly on the vessel 105, e.g., a deck of the vessel. For purposes of this disclosure, when the uni-directional passive surge damping system 135 is described as being disposed on the vessel 105, the uni-directional passive surge damping system can be disposed entirely on the vessel support structure 125, directly on the vessel, e.g., a deck of the vessel, or some components of the uni-directional passive surge damping system 135 can be disposed on the vessel support structure 125 and some components of the uni-directional passive surge damping system 135 can be disposed directly on the vessel, e.g., a deck of the vessel.

The uni-directional passive surge damping system 135 can include one or more damping apparatus (four are shown) 101, 102, 103, 104. The uni-directional passive surge damping system 135 can also include one or more sheaves or pulleys 127. In some embodiments, each damping apparatus 101, 102, 103, 104 can include 1, 2, 3, 4, or more pulleys 127. The uni-directional passive surge damping system 135 can be connected to the ballast tank 130 to dampen ballast tank motion. The connection between the uni-directional passive surge damping system 135 and the ballast tank 130 can be via one or more elongated supports or elongated tension members 132 (four are shown). The elongated tension members 132 can be or can include rope, cable, wire, chain, or the like, as well as any combinations of the same. The elongated tension members 132 can be designed to support loads in tension only. For example, the elongated tension members 132 can be flexible in nature and can have low or negligible bending and compression strength as compared to the tensile strength of the elongated tension member 132. In some embodiments, the elongated tension member 132 can be a cable or wire rope can and be constructed in any manner including fiber core, independent wire rope core, wire strand core or any other type of construction that will be evident to those skilled in the art. The cable or wire rope can be constructed of any suitable material. In some embodiments, the cable or wire rope can be constructed from stainless steel, galvanized steel, or other suitable material that is evident to those skilled in the art. In other embodiments, the elongated tension member 132 can be a rope constructed from a polypropylene, a nylon, a polyester, a polyethylene, an aramid, an acrylics, or any combination thereof.

In some embodiments, the elongated tension members 132 can be connected to the damping apparatus 101, 102, 103, 104 at one end and connected to the ballast tank 130 at the other end. In other embodiments, the elongated tension members 132 can be connected to the vessel 105 and/or the vessel support structure 125 at one end or a first end, routed through or around a portion of the damping apparatus 101, 102, 103, 104 and/or pulley(s) 127, and connected to the ballast tank 130 at the other end or a second end. The elongated tension members 132 can be tensioned between the damping apparatus 101, 102, 103, 104 and the ballast tank 130 to control a back and forth (longitudinal), a left and right (transverse), and/or an up and down (vertical) motion of the ballast tank 130. Accordingly, and as explained further below, the uni-directional passive surge damping system 135 can be configured to or adapted to dampen reduce the back and forth (longitudinal), left and right (transverse), and/or the up and down (vertical) motion of the ballast tank 130.

The uni-directional passive surge damping system 135 can include one or more attachment locations, spools, or winches 138 (four are shown). In some embodiments, a first elongated tension member 132 can be connected at one end to a first attachment location 138, routed through or around a portion of a first damping apparatus, for example damping apparatus 101, and/or one or more first pulleys 127, and at the other end to the ballast tank 130. A second elongated tension member 132 can be connected at one end to a second attachment location 138, routed through or around a portion of a second damping apparatus, for example damping apparatus 102, and/or one or more second pulleys 127, and at the other end to the ballast tank 130. A third, fourth, or even more elongated tension members 132 can be connected between a third, fourth, or even more attachment locations 138, round through or around a portion of a third, fourth, or more damping apparatus, for example damping apparatus 103 and 104, and/or one or more third or fourth pulleys 127, and the other end to the ballast tank 130. In some embodiments, the uni-directional passive surge damping system 135 can be or can include any combination of one or more compensating cylinders, accumulators, manifold blocks, coolers, and pulleys.

The ballast tank 130 can be any container, drum or the like capable of holding water, high density concrete blocks, or other ballast. The ballast tank 130 can be connected to the yoke 110 and the extension arm(s) 120. The ballast tank 130 can be connected to the vessel support structure 125 through the one or more extension arms 120. As such, the ballast tank 130 can be configured to or adapted to move back and forth, left and right and/or an up and down with respect to the vessel support structure 125. In some embodiments, the ballast tank 130 can be configured to or adapted to move back and forth, left and right, and/or up and down below the vessel support structure 125. The ballast tank 130 can serve as a counterbalance or restoring force as the vessel 105 moves at sea. In operations, as the vessel 105 moves due to sea and other environmental conditions, the ballast tank 130 is lifted up and thus potential energy, the restoring force, is available to restore the vessel 105 to its original position.

The yoke 110 can be any elongated structure with sufficient strength to connect the vessel 105 to an offshore structure. For example, the yoke 110 can be formed from one or more tubular members or legs 112, 114. Each tubular member can have a circular, squared, or other polygonal cross-sectional shape. In certain embodiments, the yoke 110 can have two legs arranged in a "V" shape in plan view that are connected to the ballast tank 130 at one end and connected to the yoke head 115 at the other end.

The vessel support structure 125 can be a raised tower or other framed structure for supporting the yoke 110, the ballast tank 130, and the extension arms 120. The vessel support structure 125 can be disposed on or otherwise secured to the vessel 105. In some embodiments, at least a portion of the vessel support structure 125 can be cantilevered over a side of the vessel 105. For example, the vessel support structure 125 can include a generally vertical section 153 and a generally horizontal section 155 and at least a portion of the generally horizontal section 155 can be cantilevered over a side of the vessel 105. The generally horizontal section 155 can extend beyond the side of the vessel 105 and can help support the weight of the ballast tank 130, extension arms 120, and yoke 110.

The extension arms 120 can be connected to the vessel support structure 125 via one or more upper U-joints 142. In some embodiments, the extension arms 120 can be connected to the cantilevered portion of the vessel support structure 125, for example on the generally horizontal section 155, via the one or more upper U-joints 142. The extension arms 120 can also be connected to the ballast tank 130 using one or more lower U-joints 144. The extension arms 120 can include one or more jointed sections that are mechanically connected together. The extension arms 120 can each be or can include rigid pipe, conduit, rods, chains, wire, cables, combinations thereof, or the like. The vessel support structure 125 via connection through the extension arms 120 and U-joints 142, 144 can suspend the ballast tank 130 and the yoke 110. The U-joints 142, 144 can allow the ballast tank 130 to move back and forth (longitudinal), left and right (transverse), and/or up and down (vertically) under the vessel support structure 125. The U-joints 142, 144 are provided as one type of coupler that can be used, however, any type of coupling that permits angular movement between its connections can be equally employed.

As explained in more detail below, the uni-directional passive surge damping system 135 can apply tension to the ballast tank 130 at the requisite tensions and loads to dampen or reduce the back and forth (longitudinal), left and right (transverse), and/or the up and down (vertical) movement of the ballast tank 130 while the vessel 105 and the damped yoke mooring system 100 is connected to the mooring support structure 150, and while the vessel 105 is transported to, connecting to, and/or disconnecting from the mooring support structure 150, at sea, using only the facilities located on the vessel 105 itself. The uni-directional passive surge damping system 135 can be used independently or in combination with other systems on the vessel 105, for example one or more winch systems, not shown.

The one or more damping apparatus 101, 102, 103, 104 can be used in parallel or in series. In certain embodiments, the one or more damping apparatus 101, 102, 103, 104 can be used in tandem (i.e. series) where one or more first damping apparatus 101, 102, 103, 104 can work at low tension to dampen or reduce the movement of the ballast tank 130, and one or more second damping apparatus, not shown, can be added to operate and handle higher tension requirements, such as during heavy sea states. In certain embodiments, the one or more damping apparatus 101, 102, 103, 104 can be used in parallel as shown where the one or more damping apparatus 101, 102, 103, 104 can operate at higher tension requirements, such as during heavy sea states. The one or more damping apparatus 101, 102, 103, 104 can be or can include one or more shock absorbers, one or more pulleys, one or more pulleys with integrated torsional springs, one or more wire line tensioners, one or more N-Line tensioners, one or more hydraulic and/or pneumatic cylinders with one or more oil and/or gas accumulators, and combinations thereof. The one or more damping apparatus 101, 102, 103, 104 can be accumulator loaded or pressurized to set a tension in the one or more elongated tension members 132.

In some embodiments, when weather conditions and sea states are relatively calm, the uni-directional passive surge damping system 135 can be disconnected from the ballast tank 130 and reconnected if weather conditions and sea states require. In operation, the uni-directional passive surge damping system 135, for example, can be used to dampen horizontal and vertical movement of the ballast tank 130, while the vessel 105 is connected to the mooring support structure 150. By providing damping, the uni-directional passive surge damping system 135 can significantly reduce the mooring loads on the mechanical components of the damped yoke mooring system 100, such as the yoke head 115 and U-Joints 142, 144.

In some embodiments, the mooring support structure 150 can be a raised tower, framed structure, or other base structure 170 fixedly attached to a seafloor. In other embodiments, the mooring support structure 150 can be a floating, an anchored, or a moored structure. In some embodiments, the mooring support structure 150 can include a base or jacket structure 180. The base structure 180 can be fixedly attached to the seafloor or connected to the one or more pilings or piling foundations, not shown. In some embodiments, the base structure 180 can be fixedly connected to a dock or other man-made structure, a coastal defense structure, land above sea-level, land below sea-level, and/or combinations thereof. Coastal defense structures can be or can include, but are not limited to, a jetty, a groin, a seawall, a breakwater, or the like. The base structure 180 can also be floating, anchored, or moored. The base structure 180 can include a turntable 155 disposed thereon. The turntable 155 can be configured to at least partially rotate about the base structure. In some embodiments, the base structure 180 can include a support column 175 disposed thereon. The support column 175 can include a plurality of decks (three are shown) 185, 187, 189 disposed about and/or on the support column 175 at various elevations above and/or below a water line, not shown. In some embodiments, the decks 185, 187, 189 can be arranged and designed to support various processing equipment, manifolds, etc.

In some embodiments, the turntable 155 can be disposed on the support column 175. In some embodiments, the turntable 155 can include a roller bearing 157 to allow the turntable to freely weathervane about the mooring support structure 150. In other embodiments, the turntable 155 and/or bearing 157 can be configured to or adapted to have a limited rotational travel about the column 175, for example, the rotational travel can be limited to less than plus or minus one-hundred and eighty degrees about the column 175. For example, the rotational travel of the bearing 157 can be configured to or adapted to be limited to less than plus or minus ninety degrees, plus or minus forty-five degrees, plus or minus thirty degrees, plus or minus fifteen degrees, or any rotational travel limitations therebetween including eliminating all rotational travel about the turntable 155. To limit the rotational travel of the turntable 155 and the bearing 157, the turntable 155 and/or the bearing 157 can include mechanical stops, shock absorbers, springs, chains, cables, electric motors, hydraulic cylinders and/or combinations thereof. In some embodiments, one or more decks, for example the decks 187, 189, can be located above the turntable 155 and the decks 187, 189 can rotate about the mooring support structure 150 with the turntable 155. The yoke head 115 can be connected to the turntable 155. The connection can be via one or more trunnions 191. The one or more trunnions 191 can allow the yoke head 115 and the yoke 110 to pitch and/or roll relative to the turntable 155.

By "vessel" it can be meant any type of floating structure including but not limited to tankers, boats, ships, FSO's, FPSO's and the like. It should be appreciated by those skilled in the art that the damped yoke mooring system 100 can be mounted on converted vessels as well as new-built vessels.

Figure 2:
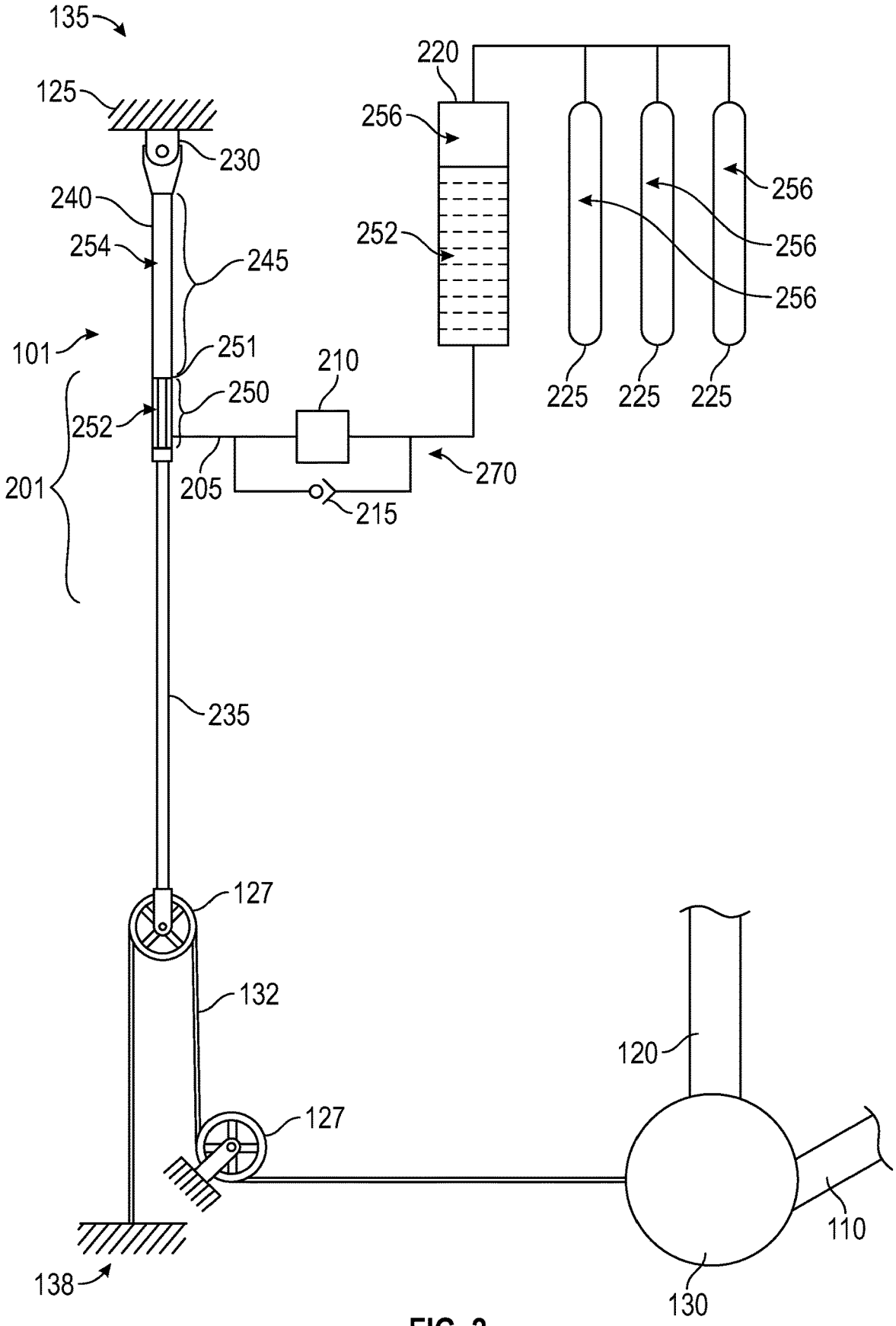
FIG. 2 depicts a schematic of an enlarged view of the illustrative damping apparatus and pulley arrangement of the uni-directional passive surge damping system shown in FIG. 1, according to one or more embodiments.

FIG. 2 depicts a schematic of an enlarged view of the illustrative damping apparatus 101 and pulley 127 arrangement of the uni-directional passive surge damping system 135 shown in FIG. 1, according to one or more embodiments. In some embodiments, the damping apparatus 101 can be or can include an N-Line tensioner 201. The N-Line tensioner 201 can include a piston 235 disposed within a cylinder 240 and can be connected to the ballast tank 130 via the elongated tension member 132. The elongated tension member 132 can be routed over or around a portion of the one or more pulleys 127 and connected at one end to the ballast tank 130 and at a second end to the first attachment location 138. The first attachment location can be located on the vessel 105, e.g., on the vessel support structure 125. The cylinder 240 can be connected at one end, via for example a U-joint 230, to the vessel support structure 125 and the piston 235 can be disposed within the cylinder 240 at the other end. One or more moveable seals 251 can be disposed within the cylinder 240 and connected to a first end of the piston 235. A first pulley 127 can be connected to a second end of the piston 235. A chamber separated into a first volume 245 and a second volume 250 by the moveable seal 251 can be formed within the cylinder 240. The moveable seal 251 can travel within the chamber as the piston 235 is extended from and retracted into the cylinder 240. As the moveable seal 251 travels within the cylinder 240, the first volume 245 and the second volume 250 can be changed, increasing and decreasing a first pressure and a second pressure, respectively, corresponding to the first volume 245 and the second volume 250. The first and second volumes 245, 250 can be filled with one or more fluids. For example, a liquid 252 such as hydraulic fluid can be disposed within the second volume 250 and a gas 254 such as nitrogen can be disposed within the first volume 245. The liquid 252 can be any liquid including water, oil, and combinations thereof. The gas 254 can be any gas including air, nitrogen, carbon dioxide, argon, helium, and mixtures thereof. The moveable seal 251 can isolate the liquid 252 from the gas 254 as the piston 235 extends from and retracts into the cylinder 240.

The N-Line tensioner 201 can include one or more cylinders 240 that can be either single or double effect hydraulic cylinders. A manifold block 270 can be in fluid communication with the one or more hydraulic cylinders 240. In some embodiments, the manifold block 270 can include one or more fluid lines 205, one or more pressure reducing fittings 210, and one or more check valves 215. Suitable pressure reducing fittings can be or can include, but are not limited to, throttle valves, static control valves, gate valves, glove valves, butterfly valves, orifices, reducers, pressure safety valves, pressure relief valves, or other valves, fittings, or reduced diameter pipes that function to reduce a pressure in a piping system. In some embodiments, the pressure reducing fitting 210 can be free from any active control system. As such, the pressure reducing fitting 210 can be configured to regulate the flow of a fluid and can be adjusted to adjust the rate of the flow of the fluid via a handwheel, lever, knob, or other mechanism. In other embodiments, the pressure reducing fitting 210 can be controlled via an active control system. For example, the pressure reducing fitting 210 can be configured to regulate the flow of a fluid and can be adjusted to adjust the rate of the flow of the fluid via an actuator controlled by a control system. The check valve 215 is a valve that allows fluid to flow through it in only one direction.

The manifold block 270 can be in fluid communication with at least the second volume 250 within the cylinder 240 and one or more accumulators 220 (one is shown). The manifold block 270 can be configured to restrict the flow of a fluid from the cylinder 240 into the accumulator 220 such that the pressure in the hydraulic cylinder increases as the speed of the ballast tank increases in a direction away from the vessel 105. The increase in pressure in the hydraulic cylinder 240 as the speed of the ballast tank 130 increases in a direction away from the vessel 105 can increase a force applied to the elongated tension member 132. In some embodiments, the magnitude of the force applied to the elongated tension member 132 can increase as the speed of the ballast tank 130 increases in a direction away from the vessel 105. At least a portion of the force can be transferred to the ballast tank 130 as the tension applied by the elongated tension member 132. As such, in some embodiments, the magnitude of the tension applied to the ballast tank 130 by the elongated tension member 132 can increase as the speed of the ballast tank 130 increases in a direction away from the vessel 105. In some embodiments, the one or more pressure reducing fittings 210 in the manifold block 270 can be configured to restrict the flow of the fluid from the volume 250 within the cylinder 240 into the accumulator 220 such that the pressure in the hydraulic cylinder 240 increases as the speed of the ballast tank increases in a direction away from the vessel 105.

The one or more accumulators 220 can be configured to or adapted to be pressurized by a gas 256 within one or more pressure vessels 225 (three are shown) such that as the first volume 250 changes, the pressure within the first volume 250 can be maintained within a desired range. The gas 256 can be any gas including air, nitrogen, carbon dioxide, argon, helium, and mixtures thereof. By pressurizing the one or more accumulators 220, the N-Line tensioner 201 can be pressure loaded and a tension on the elongated tension member 132 between the first attachment location 138 and the ballast tank 130 can be maintained. The pressure reducing fitting 210 can control the pressure in the fluid lines 205 and the first volume 250 during the extension of the piston 235. As such, the pressure reducing fitting 210 can allow the uni-directional passive surge damping system 135 to increase the tension applied to the ballast tank 130 by the elongated members 132 as a speed of the ballast tank moving away from the vessel increases.

The manifold block 270 can be configured to or adapted to allow fluid to flow from the accumulator 220 into the hydraulic cylinder 240 to apply a force to the elongated tension member 132 that is not dependent on a speed of the ballast tank 130 as the ballast tank 130 moves toward the vessel 105. In some embodiments, the one or more check valves 215 can control fluid flow from the one or more accumulators 220 during retraction of the piston 235. The accumulators 220 can pump fluid into the one or more cylinders 240 to retract the piston 250 when the ballast tank 130 moves toward the one or more cylinders 240 and tension on the elongated tension members 132 decreases. As such, the uni-directional passive surge damping system 135 can be configured to not increase the tension applied to the ballast tank 130 by the elongated member 132 as a speed of the ballast tank 130 moving toward the vessel 105 increases. Said another way, the uni-directional passive surge damping system 135 can be configured to or adapted to apply a substantially constant tension via the elongated tension member 132 to the ballast tank 130 as the ballast tank 130 moves toward the vessel 105. As such, the tension applied to the ballast tank by the elongated tension member can remain substantially constant as a speed of the ballast tank moving toward the vessel increases. In some embodiments, the tension applied to the ballast tank 130 by the elongated tension member 132 as the ballast tank 130 moves away from the vessel 105 can be greater than the tension applied to the ballast tank 130 by the elongated member 132 as the ballast tank 130 moves toward the vessel 105.

In some embodiments, one or more hydraulic power units (HPU), not shown, can recharge the accumulators 220 and/or hydraulic cylinders 240 if liquid 252 is lost. The HPU can be in fluid communication with the hydraulic cylinder 240 and/or the accumulator 220 and configured to recharge additional liquid 252 thereto. The one or more HPUs can be operated to manually extend and retract the piston 235 for connection/disconnection from the uni-directional passive surge damping system 135.

One or more heat exchangers, not shown, can be in fluid communication with the manifold block 270 to dissipate the energy absorbed in the system. In some embodiments, the heat exchanger (now shown) can be configured to remove heat generated by the uni-directional passive surge damping system 135 when the uni-directional passive surge damping system 135 dampens the movement of the ballast tank 130.

In some embodiments during operations, sea motion can cause the ballast tank 130 to move away from the vessel 105 and thus move away from the uni-directional passive surge damping system 135. As the ballast tank 130 moves away, the elongated tension member 132 moves over the pulleys 127 causing the piston 235 to extend from the cylinder 240. The subsequent movement of the moveable seal 251 within the cylinder 240 can decrease the total volume of the second volume 250 within the cylinder 240 and hence push the fluid in the second volume 250 into the accumulator 220 via the fluid lines 205. Since the check valve 215 blocks the fluid flow from the cylinder 240 to the accumulator 220 by its one-way flow function, the fluid has to go through the pressure reducing fitting 210 which in turn increase the pressure acting upon the movable seal 251. The subsequent increased pressure in turn can increase the tension and energy to a sufficient level capable of extending the piston 235 further from the cylinder 240. The increased pressure can dampen the forces on the ballast tank 130 caused by motions of the vessel 105, motions such as heave, roll, and/or pitch. As the ballast tank 130 moves back toward the vessel, the one or more accumulators 220 can control the pressure within the cylinder 240 to retract the piston 235 such that the tension on the elongated tension members 132 can be maintained within a specified reduced range, keeping the line in low tension, which in turn can reduce or prevent line slack and/or the line from jumping or otherwise moving out of pulley 127. When the fluid flows from the accumulator 220 to the cylinder 240, the check valve can be opened to allow the fluid to flow through its one-way flow function. The tension on the elongated tension members 132 can be maintained, at least in part, by the pressure inside the accumulator 220. In other embodiments, the one or more pulleys 127 can include torsional springs that can impart a torsional force on the one or more pulleys 127 as the elongated tension member 132 is pulled in and out by the ballast tank 130 and the pulleys 127 rotate. The subsequent torsional force on the pulleys 127 can maintain or assist in maintaining the tension on the elongated tension member 132, damping the forces on the ballast tank 130. In still other embodiments, the damping apparatus 101 can be replaced by a spring or telescoping shaft and the pulleys 127 with torsional springs can maintain the tension on the elongated tension member 132.

In a prophetic example, a computer simulation is ran. A yoke mooring system is coupled with the uni-directional passive surge damping system 135 to simulate the damped yoke mooring system 100. The uni-directional passive surge damping system 135 included five damping apparatus, similar to the damping apparatus 101 shown in FIG. 2, each with one of five elongated tension members routed therethrough and connected to the ballast tank 130. The tension of the elongated tension member 132 per unit is set to increase to a maximum of 50 metric tons in the extension direction and is maintained at 2 metric tons in the retraction direction. As such, the uni-directional passive surge damping system 135 in this prophetic example applies up to 250 metric tons in the extension direction and applies 10 metric tons in the retraction direction. The tension applied to the ballast tank 130 by each elongated member 130 increases as a speed of the ballast tank 130 moving away from the vessel 105 increases. The tension applied to the ballast tank 130 by each elongated member 130 is maintained at 2 metric tons as the ballast tank 130 moves toward the vessel 105 and does not increase as a speed of the ballast tank 130 moving toward the vessel 105 increases. The simulated vessel is a Suezmax size (maximum size vessel that can traverse the Suez canal) oil tanker converted into a floating production, storage, and offloading vessel with a length of 275 meters, a beam of 48 meters, and a depth of 23.2 meters with a fully loaded draft of 17 meters. The simulated damped yoke mooring system 100 includes 1,200 metric tons of ballast in the ballast tank 130. There are two extension arms 120 connected to the ballast tank 130 and suspended from the vessel 105. The extension arms 120 are 21 meters in length and the yoke 110 is 45 meters long. A time domain simulation is run with 100 year winter storms with significant wave heights (Hs) of 8.0 meters. Assuming four cylinder and elongated tension member combinations are operational, the vessel surge motion is significantly reduced, and the mooring load is reduced by up to 24%. The results show the maximum calculated surge motion with the uni-directional passive surge damping system is 4.1 meters less than that without the uni-directional passive surge damping system. In the simulation, the calculated mooring load rises rapidly around the extreme offset or surge motion of the ballast tank between about 14 meters to about 18 meters away from the vessel. The rapid mooring load rise is called "hardening" nonlinear stiffness of the yoke mooring system. Without the uni-directional passive surge damping system 135, the calculated mooring load is as high as 1,793 metric tons, which exceeds the capability of the simulated damped yoke mooring system 100. However, with the assistance of the uni-directional passive surge damping system 135, the maximum surge motion is damped down to 12.87 meters, which is outside of the "hardening" nonlinear region. Thus, the resulting extreme mooring load is calculated to be no more than 1,264 metric tons, which is well below the capability of the simulated yoke mooring system mechanism and parts. Accordingly, with the damping system 135, the damped yoke mooring system 100 supports mooring a vessel to a mooring support structure even during heavy sea states. Table 1 contains some of the simulation results as it relates to the prophetic example.

TABLE 1

Simulation Result Comparison

| | Maximum Mooring Load Horizontal Pulling Force Fx (MT) | Maximum Mooring Load Horizontal Pushing Force Fx (MT) | Max. vessel Surge Motion Away from Mooring Support Structure (m) | Max. vessel Surge Motion Near to Mooring Support Structure (m) |
|---|---|---|---|---|
| Result with the Unidirectional Passive Surge Damping System | 1,264 | 831 | 12.87 | 7.72 |
| Result without the Unidirectional Passive Surge Damping System | 1,792 | 1,415 | 16.95 | 9.94 |

Figure 3:
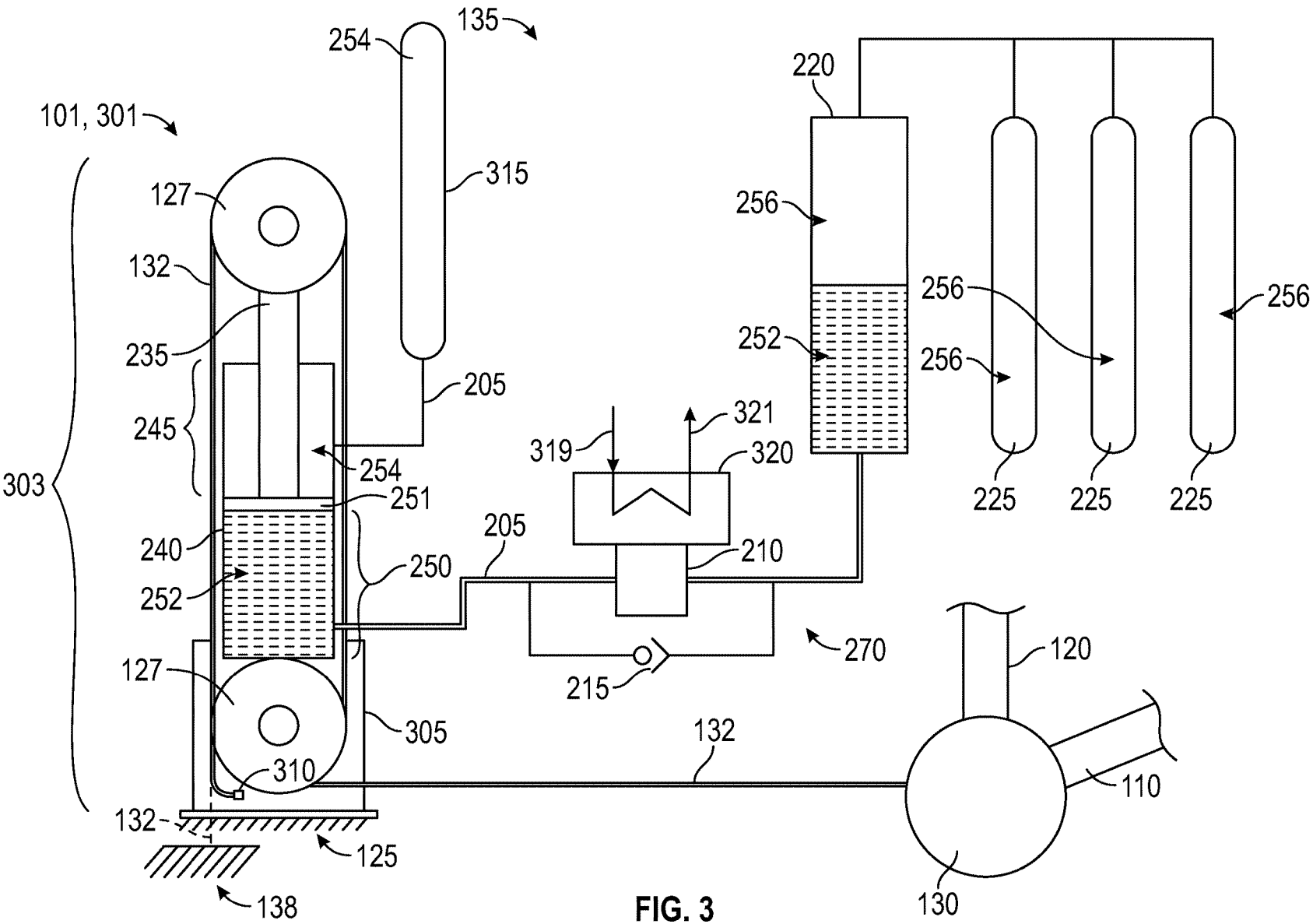
FIG. 3 depicts a schematic of another illustrative damping apparatus and pulley arrangement that the uni-directional passive surge damping system can include, according to one or more embodiments.

FIG. 3 depicts a schematic of another illustrative damping apparatus 101 and pulley 127 arrangement that the uni-directional passive surge damping system 135 can include, according to one or more embodiments. In some embodiments, the damping apparatus 101 can be or can include a wire line tensioner 301. The wire line tensioner 301 can include one or more pistons 235 (one is shown) disposed within one or more cylinders 240 (one is shown) and can be connected to the ballast tank 130 via one or more elongated tension members 132 (one is shown). The cylinder 240, piston 235, the first pulley 127, and a second pulley 127 can be configured or adapted into an assembly 303 with a base 305. The base 305 can be connected to the vessel support structure 125. The elongated tension member 132 can be at least partially routed around one or more pulleys 127. The elongated tension member 132 can be at least partially routed around the first and second pulleys 127 and can be connected at one end to the ballast tank 130 and at a second end to an attachment location 310 on the wire line tensioner 301 or optionally to the first attachment location 138.

The wire line tensioner 301, similar to the N-line tension 201 described with reference to FIG. 2, can also include the first volume 245, the second volume 250, the moveable seal 251, the piston 235, the cylinder 240, the accumulators 220, the manifold block 270, the fluid lines 205, the pressure reducing fitting 210, the check valves 215, and the pressure vessels 225. As such, the accumulator 220 can be configured to or adapted to apply a pressure to the hydraulic cylinder 240 and when the pressure is applied to the hydraulic cylinder 240, the hydraulic cylinder 240 can be configured to or adapted to apply a force to the elongated tension member 132, and at least a portion of the force can be transferred to the ballast tank 130 as the tension applied by the elongated tension member 132. Additionally, the manifold block 270 can be configured to restrict the flow of the fluid from the hydraulic cylinder 240 into the accumulator 220 such that the pressure in the hydraulic cylinder 240 increases as the speed of the ballast tank 130 increases in a direction away from the vessel 105 and the increase in pressure in the hydraulic cylinder 240 can increase the force applied to the elongated tension member 132. The manifold block 270 can also be configured to or adapted to allow fluid to flow from the accumulator 220 into the hydraulic cylinder 240 to apply a force to the elongated tension member 132 that is not dependent on a speed of the ballast tank 130 as the ballast tank 130 moves toward the vessel 105. As such, the wire line tensioner 301 can be configured to or adapted to not increase the tension applied to the ballast tank 130 by the elongated member 132 as the speed of the ballast tank 130 moving toward the vessel 105 increases.

In some embodiments, the unidirectional passive surge damping system 135 can also include one or more heat exchangers 320 configured to or adapted to indirectly exchange heat with the manifold block 270 to dissipate the energy absorbed in the system. In some embodiments, the heat exchanger 320 can be in contact with and configured to remove heat from the manifold block 270 by introducing a heat transfer fluid via line 319, indirectly transferring heat from the manifold block 270 to the heat transfer fluid to produce a heated heat transfer fluid, and removing the heated heat transfer fluid via line 320. In some embodiments, the heat transfer fluid can be water, e.g., sea water, that can be introduced via line 319 to the heat exchanger 320 and returned to the sea via line 321. In other embodiments, the heat exchanger 320 can be a closed loop system that includes one or more second heat exchangers, e.g., an air cooled heat exchanger, sea water cooled heat exchanger, or the like, configured to cool the heated heat transfer fluid. Suitable heat transfer fluids that can be used in closed loop systems can be or can include, but are not limited to, water, hydrocarbon oils, or any other suitable heat transfer fluid.

Figure 4:
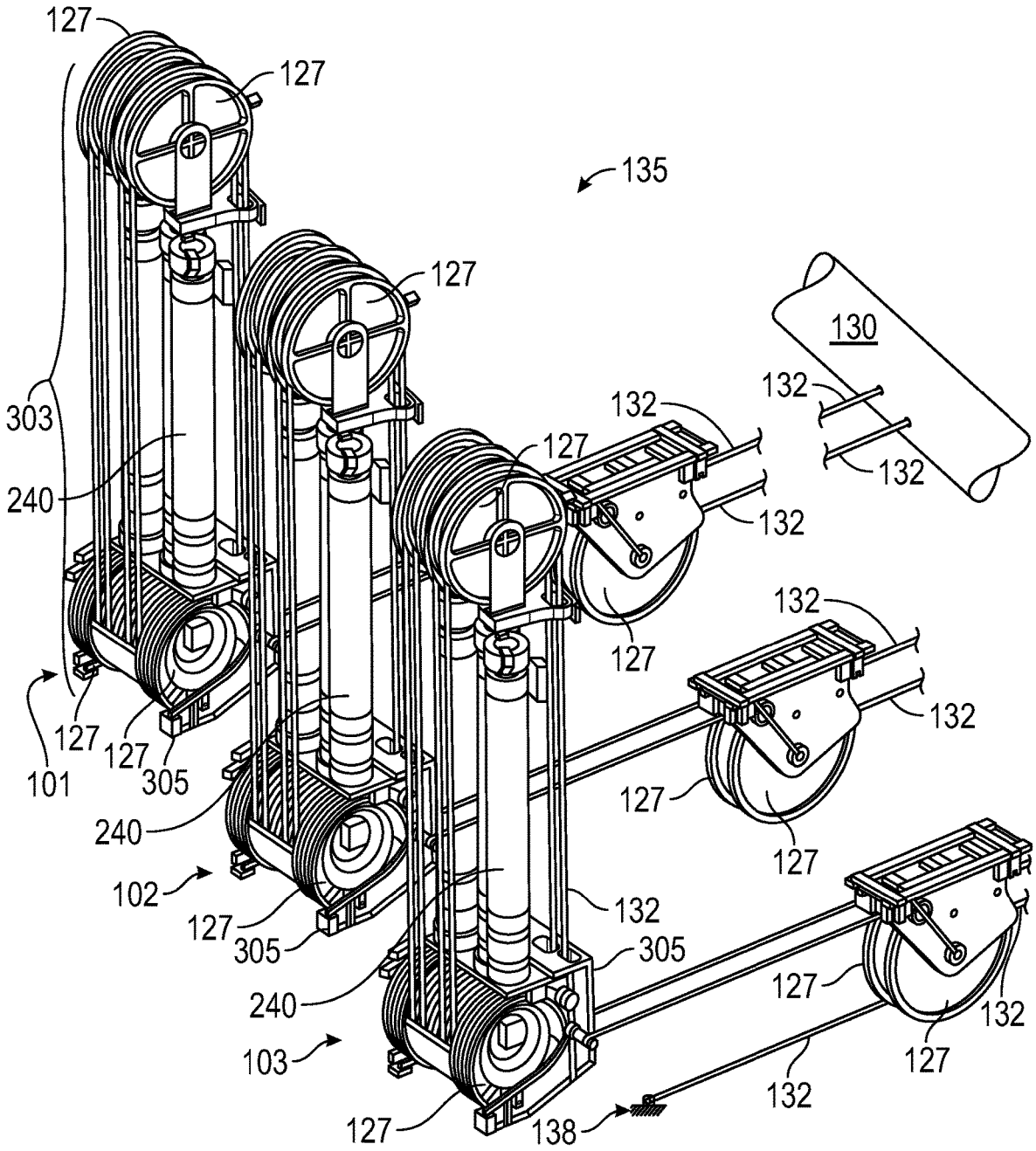
FIG. 4 depicts a schematic of a partial orthographic projection view of three wire line tensioners that can be used as the illustrative uni-directional passive surge damping system shown in FIG. 1, according to one or more embodiments.

FIG. 4 depicts a schematic of a partial orthographic projection view of three wire line tensioners 101, 102, 103 that can be used as the illustrative uni-directional passive surge damping system 135 shown in FIG. 1, according to one or more embodiments. The damping apparatus 101, 102, 103 can be wire line tensioners configured to maintain the tension on the elongated tension members 132 between the wire line tensioner 301 and the ballast tank 130. The wire line tensioner 301, similar to the N-line tension described with reference to FIG. 2, can also include the first volume 245, the second volume 250, the moveable seal 251, the piston 235, the cylinder 240, the accumulators 220, the manifold block 270, the fluid lines 205, the pressure reducing fitting 210, the check valves 215, and the pressure vessels 225.

Referring to FIGS. 3 and 4, in some embodiments during operations, as the ballast tank 130 moves away from the uni-directional passive surge damping system 135, the elongated tension member 132 causes the upper or first pulley 127 to move toward the lower or second pulley 127 and the piston 235 is retracted into the cylinder 240. The subsequent movement of the moveable seal 251 within the cylinder 240 can decrease the total volume of the second volume 250 within the cylinder 240 and hence push the fluid in the second volume 250 to accumulator 220 via the fluid lines 205. Since the check valve 215 blocks the fluid flow from the cylinder 240 to the accumulator 220 by its one-way flow function, the fluid has to go through the pressure reducing fitting 210 which in turn increases the pressure acting upon the movable seal 251. The subsequent increased pressure in turn can increase the tension and energy to a level sufficient to retract the piston 235 further into the cylinder 240. The increased pressure can dampen the forces on the ballast tank 130 caused by motions of the vessel 105, motions such as heave, roll, or pitch. As the ballast tank 130 moves toward the uni-directional passive surge damping system 135, the pressure within the second volume 150 can cause the piston to extend out of the cylinder 240 to maintain the tension on the elongated tension members 132 within a specified reduced range, keeping the line in low tension, which can reduce or prevent line slack and the line jumping or otherwise moving out of pulley 127. When the fluid flows from the accumulator 220 to the cylinder 240, the check valve can be opened to allow the fluid to flow through its one-way flow function. The tension on the elongated tension members 132 can be maintained, at least in part, by the pressure inside the accumulator 220.

An accumulator 315 can be in fluid communication with the volume 245. By pressurizing the one or more accumulators 220, 315, the wire line tensioner 301 can be pressure loaded and a tension on the elongated tension members 132 between the wire line tensioner 301 and the ballast tank 130 can be controlled and/or maintained within the specified range. Accordingly, the wire line tensioner can dampen the ballast tank 130 from the motions of the vessel 105, motions such as surge, sway, or yaw.

Figure 5:
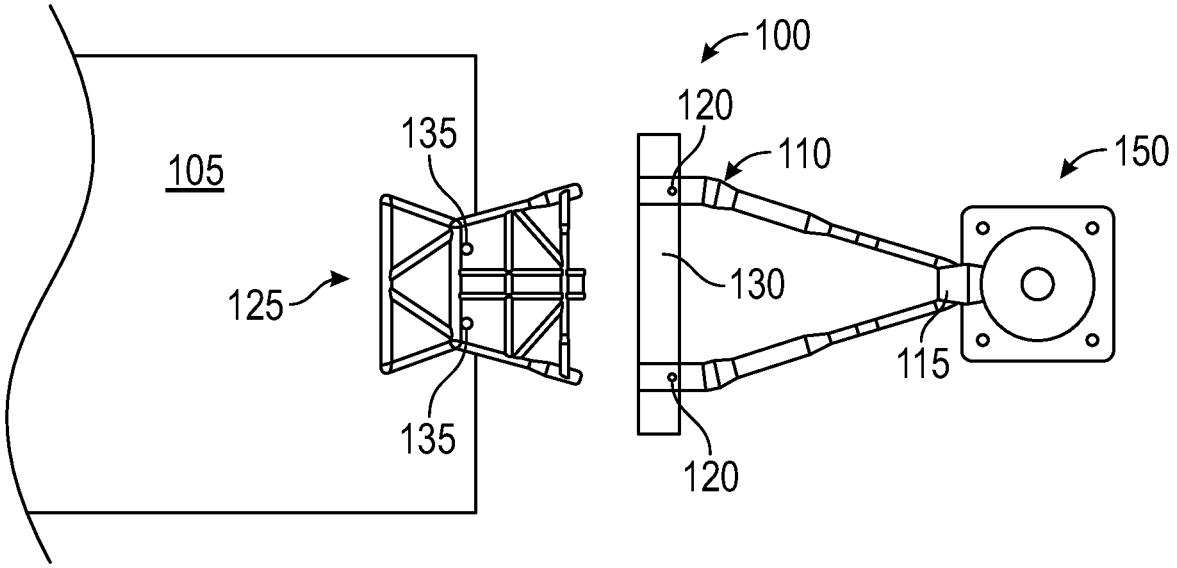
FIG. 5 depicts a schematic of the illustrative damped yoke mooring system with the uni-directional passive surge damping system prior to connection with a vessel support structure disposed on a vessel, according to one or more embodiments.
Figure 6:
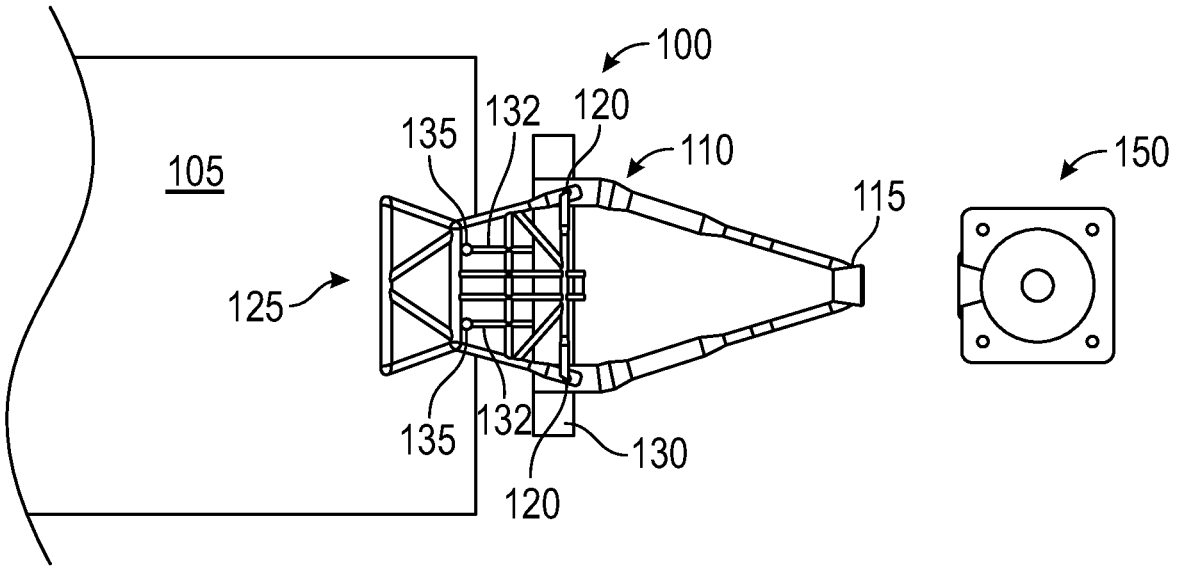
FIG. 6 depicts a schematic of another illustrative yoke mooring system with the uni-directional passive surge damping system prior to connection with the mooring support structure, according to one or more embodiments.

FIG. 5 depicts a schematic of the illustrative damped yoke mooring system 100 with the uni-directional passive surge damping system 135 prior to connection with the vessel support structure 125 disposed on the vessel 105, according to one or more embodiments. FIG. 6 depicts a schematic of another illustrative yoke mooring system 100 with the uni-directional passive surge damping system 135 prior to connection with the mooring support structure 150, according to one or more embodiments. Referring to FIGS. 5 and 6, the damped yoke mooring system 100 can be connected between the vessel support structure 125 and the mooring support structure 150 by connecting the yoke 110, yoke head 115, and ballast tank 130 to the mooring support structure 150 and then connecting the extension arms 120 to the vessel support structure 125 and the elongated tension members 132 to the ballast tank 130. In other embodiments, the damped yoke mooring system 100 can be connected between the vessel support structure 125 and the mooring support structure 150 by connecting the extension arms 120 to the vessel support structure 125 and connecting the yoke head, with the yoke 110 and the ballast tank 130, to the mooring support structure 150. The elongated tension members 132 can be connected to the ballast tank either before or after the connections between the vessel support structure 125 and the mooring support structure 150 are completed. During connection operations, one or more other vessels and/or cranes, not shown, can be utilized to the support the damped yoke mooring system 100 while the yoke head 115 is connected to the mooring support structure 150 and/or the extension arms 120 are connected to the vessel support structure 125.

Figure 7:
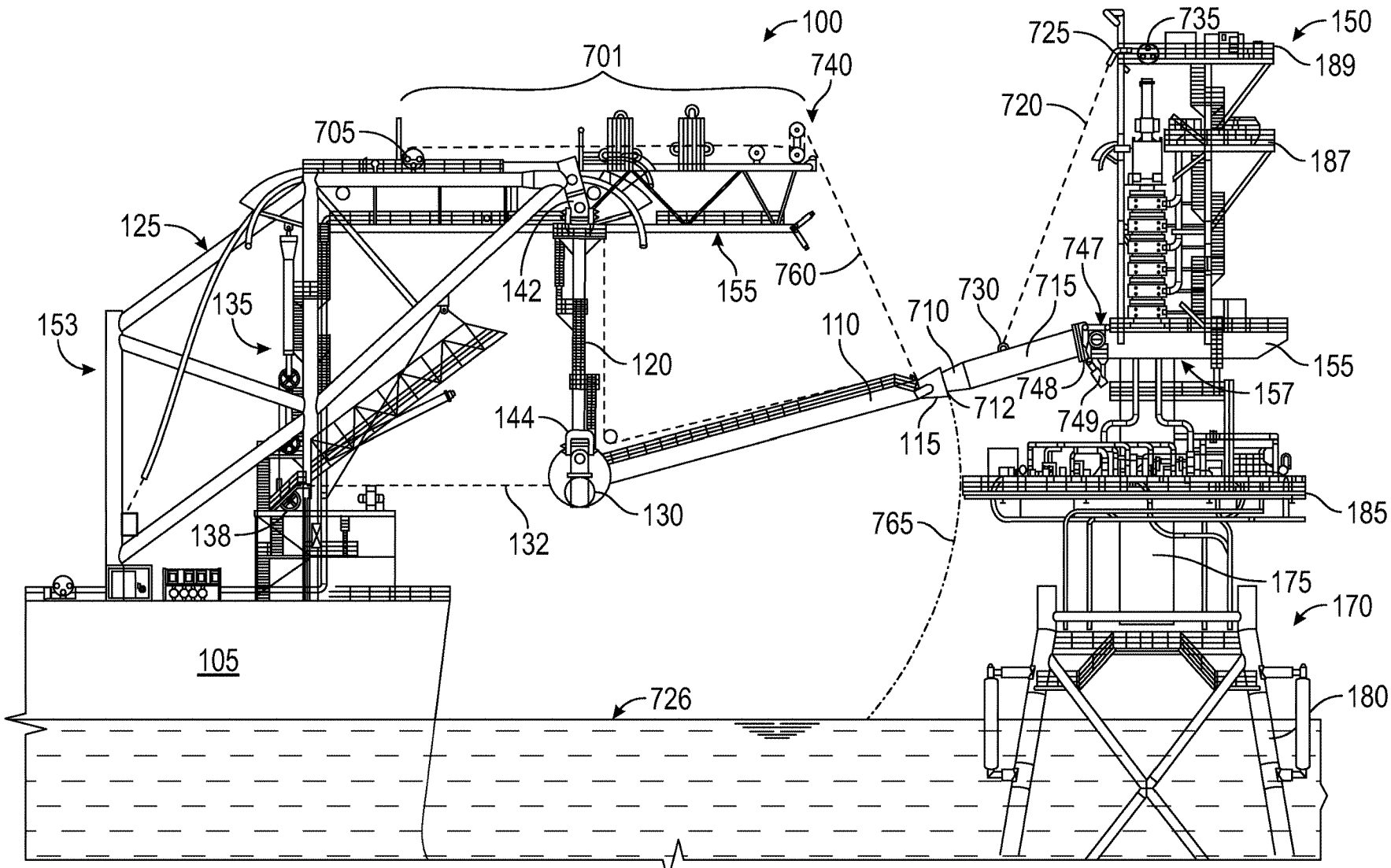
FIG. 7 depicts a schematic of another illustrative damped yoke mooring system that includes a yoke lift and cushion system and a disconnectable yoke head, and a yoke head connector with a post disposed on a mooring support structure, according to one or more embodiments.

FIG. 7 depicts a schematic of another illustrative damped yoke mooring system 100 with a yoke lift and cushion system 701 and a disconnectable yoke head 115, and a yoke head connector 710 with a post 715 disposed on the mooring support structure 150, according to one or more embodiments. The yoke lift and cushion system 701 can be disposed on the vessel 105, the vessel support structure 125, or one portion of the yoke lift and cushion system 701 can be disposed on the vessel 105 and a second portion can be disposed on the vessel support structure 125. The yoke lift and cushion system 701 can include one or more cushion cylinders 740 (one is shown). The yoke lift and cushion system 701 can include one or more winches 705 (one is shown). The yoke lift and cushion system 701 can be connected proximal to the second end or distal end of the yoke 110. The connection between the yoke lift and cushion system 701 and the yoke 110 can be via one or more elongated support members 760 (one is shown). The elongated support member 760 can be any rope, cable, wire, chain, or the like, as well as any combinations of the same. The cushion cylinder 740 can be or can include one or more shock absorbers, one or more torsional springs, one or more wire line tensioners, one or more N-Line tensioners, one or more hydraulic and/or pneumatic cylinders with one or more oil and/or gas accumulators, and combinations thereof. In some embodiments, the elongated support member 760 can be connected to the winch 705 at one end, routed around a portion of the cushion cylinder 740, and connected to the yoke 110 at the other end. In other embodiments, the elongated support member 760 can be routed around at least a portion of and connected at one end to the cushion cylinder 740 and connected at the other end to the yoke 110. In still other embodiments, a first elongated support member 760 can be connected at one end to the winch 705 and at the other end to the yoke 110. A second elongated support member 760 can be connected at one end to the cushion cylinder 740 and at the other end to the yoke 110. The winch 705 and the cushion cylinder 740 can work separately or in combination to lift, lower, and/or cushion the yoke 110 during operations.

In some embodiments, the cushion cylinder 740 can be or can include a wire line tensioner, for example the wire line tensioner 303 shown in FIG. 3. The wire line tensioner 303 can be an accumulator loaded hydraulic cylinder. The wire line tensioner 303 can include a pulley combination, for example the pulley 127 combination shown in FIG. 3, through which the elongated support member 760 can be routed and/or attached to the wire line tensioner 303. A pre-defined tension can be applied to the yoke 110 through the elongated support member 760 routed around the pulley 127 combination. The wire line tensioner can cushion the yoke 110 from the motions of the vessel 105, e.g., motions such as heave, roll, and/or pitch. The wire line tensioner 303 can also act to slow, arrest, cushion, passively support, and/or otherwise control the fall of the yoke 110 during disconnection.

In other embodiments, the cushion cylinder 740 can be or can include an N-Line tensioner, for example the N-Line tensioner 201 show in FIG. 2, where the piston 235 within the N-Line tensioner can be connected directly to the yoke 110, or to the yoke 110 via the elongated support member 760. A pulley 127 combination, for example the pulley 127 combination shown in FIG. 2, can also be included to route the elongated support member 760 to the yoke 110. The cylinder 240 can be connected to the vessel support structure 125. The N-Line tensioner 201 can slow, arrest, cushion, passively support, and/or otherwise control a fall of the yoke 110 during disconnection. The N-Line tensioner 201 can also cushion the yoke 110 from the motions of the vessel 105, e.g., motions such as heave, roll, and/or pitch.

The mooring support structure 150 can further include at least one post 715 connected at a first end to the turntable 155 and the post 715 can extend out from the turntable 155. In some embodiments, the post 715 can be connected at a first end to a pitch bearing 747 that can be connected to the turntable 155 and can extend out from the pitch bearing 747. In some embodiments, the post 715 can be connected at the first end to a roll bearing 748 that can be connected to and extend from the turntable 155. In some embodiments, the pitch bearing 747 and the roll bearing 748 can be connected to each other and can be disposed between the post 715 and the turntable 155. The pitch bearing 747 and the roll bearing 748 can allow the post 715 to rotate about the pitch bearing 747 and/or the roll bearing 748. For example, the post 715 can be connected to the roll bearing 748 that can include a race with bearings to allow for rotational movement about and relative to a longitudinal axis defined between the first end and a second end of the post 715. The pitch bearing 747 can allow the post to rotate in an upward and downward direction with respect to the turntable 155.

The post 715 can have any desired shape, e.g., a cylindrical shape, a cuboid shape, a triangular prism, or any other desired shape. In some embodiments, the post 715 can be formed from one or more tubular members. Each tubular member can have a circular, squared, triangular, or other polygonal cross-sectional shape. In some embodiments, the post 715 can be rigid and can have a fixed length. In other embodiments, the post 715 can be or can include two or more members. In still other embodiments, the post 715 with the two or more members can be configured in a telescoping arrangement with respect to one another.

A support member 720 can be attached to and extend from a mooring support structure anchor location 725 on the mooring support structure 150. The mooring support structure anchor location 725 can be at an elevated position above the turntable 155 and can rotate with the turntable 155. The mooring support structure anchor location 725 can be or can include an eyelet, a post, a grommet, an indentation, an aperture, a winch, a protrusion, or any other structure or combination of structures to which the support member 720 can attach. The support member 720 can be a rope, chain, wire, rigid rod, flexible rod, piston and rod, or any combination or one or more thereof. The length of the support member 720 can be varied such that an angle at which the post 715 extends from the turntable 155 can be varied or otherwise adjusted to any desired angle. In some embodiments, a winch 735 can vary the length of the support member 720 and thereby vary the angle at which the post 715 extends from the turntable 155. The length of the support member 720 can be from or between about one-hundred, seventy-five, sixty, fifty, forty, thirty, twenty, fifteen, ten, five, four, three, two, or one meters long. One or more hydraulic or pneumatic cylinders and/or arms 749 can be attached between the turntable 155 and/or pitch bearing 747 and the post 715 or the roll bearing 748 to support the post 715 and/or vary or otherwise adjust the angle at which the post 715 extends from the turntable 155.

The support member 720 can be attached to the post 715 at a post anchor location 730. The post anchor location 730 can be located anywhere along the post 715. For example, the post anchor location 730 can be located proximal to the second end of the post 715. The post anchor location 730 can be located about half-way between the first end and the second end of the post 715. The post anchor location 730 can be located at a point measured from the second end of the post 715 toward the first end of the post 715 at about ninety-five, ninety, eighty, seventy-five, seventy, sixty-five, sixty, fifty-five, forty-five, forty, thirty-five, thirty, twenty-five, twenty, fifteen, ten, or five percent of the measured distance. The post anchor location 730 can be or can include an eyelet, a post, a grommet, an indentation, an aperture, a winch, a protrusion, or any other structure or combination of structures to which the support member 720 can attach. In other embodiments, the support member 720 can be disposed at the post anchor location 730 about an outer perimeter of the post, e.g., in a looped configuration.

A yoke head connector 710 can be connected to the second end of the post 715. As described further below, the yoke head connector 710 can be configured to or adapted to cooperatively attach to the yoke head 115.

The length of the post 715, the yoke head connector 710, or the combination thereof can provide a disconnection location 712 at a distal end of the yoke head connector 710, between the mooring support structure 150 and the vessel 105 such that during disconnection, the yoke head 115 can fall by gravity, for example along an arc 765, without contacting the mooring support structure 150. Said another way, the disconnection location 712 at the distal end of the yoke head connector 710 can be located such that when the yoke head 115 is disconnected from the yoke head connector 710, the yoke head 115 can fall, e.g., by gravity along the arc 765, from the yoke head connector 710 without contacting the mooring support structure 150. In other embodiments, the disconnection location 712 can be outside the perimeter of any deck, for example deck 185, located below the post 715.

In operation, the yoke lift and cushion system 701, for example, can be used to cushion movement of the yoke 110, including vertical movement of the yoke 110, while connecting to and/or disconnecting from the mooring support structure 150. For example, the yoke lift and cushion system 701 can be used to raise, lower, and hold the yoke 110 in position as the vessel 105 is pushed or pulled to the mooring support structure 150 for connection and to support, cushion, and/or lift the yoke 110 during disconnection from the mooring support structure 150. During disconnection, the yoke lift and cushion system 701 can control or cushion the movement of the yoke 110, allowing control of the yoke 110 to be via the cushion cylinder 740. Accordingly, active heave compensation can be eliminated from the yoke lift and cushion system 701 and the overall complexity of the associated components can be significantly simplified. For example, the winch 705 can be set to zero pull in speed and the cushion cylinder 740 can function to reduce the shock loading in the elongated support member 760 when the yoke is disconnected from the yoke connector. In this example, the cushion cylinder 740 can cushion or slow the rate of decent of the yoke 110 during disconnection rather than being required to have an ability to quickly arrest the decent so as to avoid contacting components of the mooring support structure 150 and/or to avoid damage to the yoke 110 and/or yoke head 115 due to it hitting the water line 726 at too high a speed.

The cushion cylinder 740 can limit the distance the yoke 110 can fall after disconnection by limiting the length of the elongated support member 760 that can spool or otherwise extend from the yoke lift and cushion system 701. For example, before or after disconnection, the elongated support member 760 can be disconnected from the winch 705 and attached to the cushion cylinder 740 or the winch 705 can be prevented from moving and the cushion cylinder 740 can react to any movement of the yoke 110, thereby limiting the amount of elongated support member 760 that can extend from the cushion cylinder 740 to the amount of elongated support member 760 that may be routed around the cushion cylinder 740. In some embodiments, the amount of elongated support member 760 routed around the cushion cylinder 740 can be such that the yoke 110 can fall no more than about 1 meter, 2 meters, 3 meters to about 10 meters, 20 meters, 30 meters or more after disconnection, for example from the disconnection location 712 at the distal end of the yoke head connector 710, toward the water 726. The length of the elongated support member 760 can be chosen to prevent the yoke 110 or yoke head 115 from entering the water 726 or allow the yoke 110 or yoke head 115 to enter the water 726. The overall length of the yoke 110 and yoke head 115 along with a distance between the water 726 and the ballast tank 130 can be selected to prevent the yoke 110 or the yoke head 115 from entering the water 726, regardless the length of the elongated support member 760 extending from the cushion cylinder 740. In other embodiments, the winch 705 can be allowed to freely release the elongated support member 760 and the cushion cylinder 740 can cushion the motion of the yoke 110 while the yoke falls by gravity toward the water line 125. In some embodiments, the winch 705 can be separately connected to the yoke 110 before or after the yoke 110 has been disconnected from the yoke head connector 710 and the winch 705 can lift the yoke 110 up for stowage and transport or for reconnection.

Figure 8:
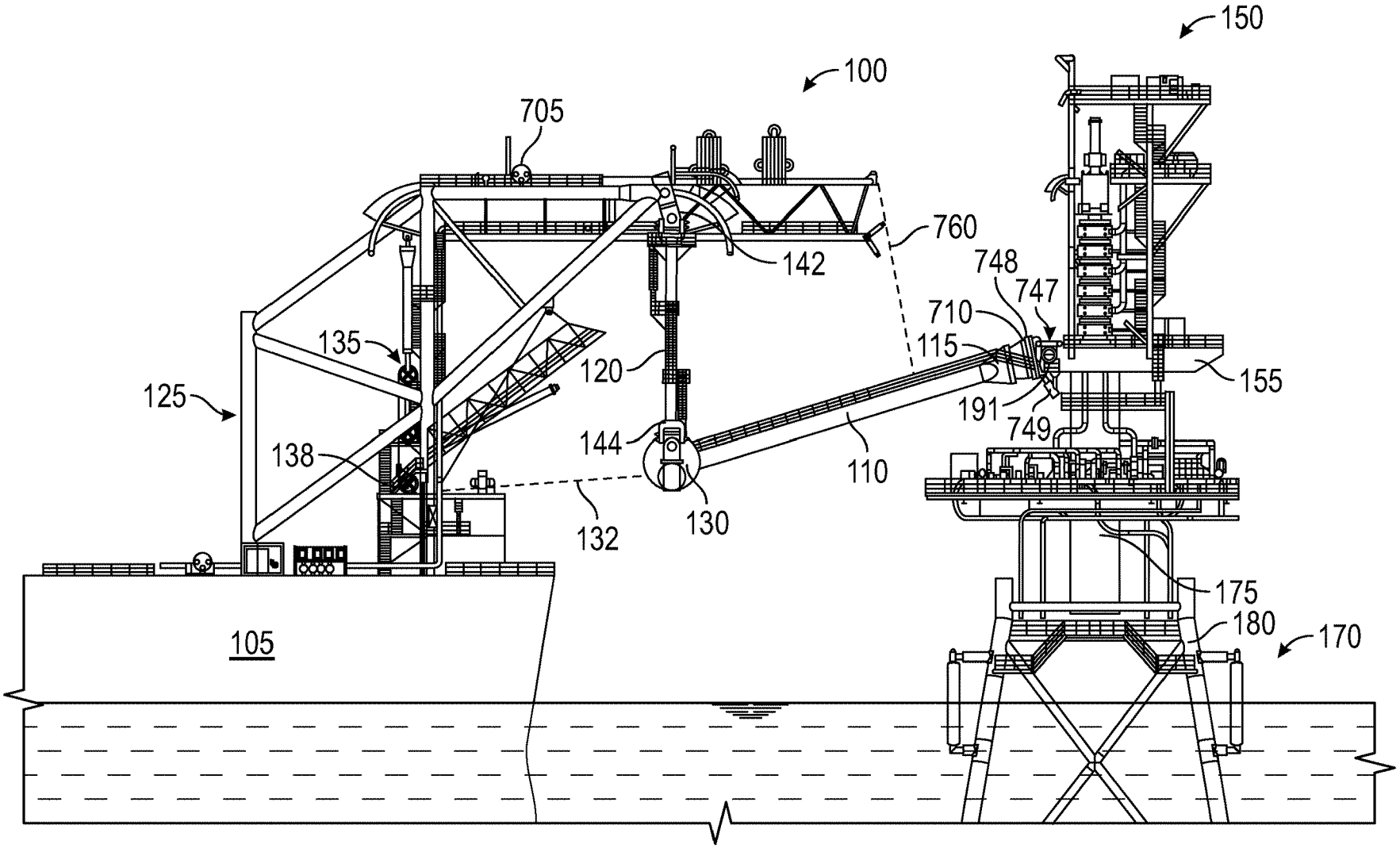
FIG. 8 depicts a schematic of another illustrative damped yoke mooring system including the uni-directional passive surge damping system and a mooring support structure having the disconnectable yoke head and yoke head connector before connection or after disconnection, according to one or more embodiments.

FIG. 8 depicts a schematic of another illustrative damped yoke mooring system 100 including the uni-directional passive surge damping system 135 and the mooring support structure 150 having the disconnectable yoke head 115 and yoke head connector 710 before connection or after disconnection, according to one or more embodiments. The vessel 105 can be brought to the mooring support structure 150 configured with the vessel support structure 125 and the damped yoke mooring system 100. The mooring support structure 150 can be connected to and disconnected from the mooring support structure 150. To facilitate this connection, the mooring support structure 150 can include the yoke head connector or receptacle 710 located on the turntable 155 that can receive the yoke head 115 located on or near the distal end of the yoke 110.

A yoke lift winch system 705 can be connected to the yoke 110 using rope, cable, wire, chain or the like, or any combinations of the same. The yoke lift winch system 705 can be used for controlling the movement of the yoke 110. The yoke lift winch system 705 can be motion compensated to support the yoke 110 during connection and disconnection with the mooring support structure 150. The yoke lift winch system 705 can be located on the vessel support structure 150 or on a deck of the vessel 105. The size, weight, and overall geometry of the yoke lift winch system 705 can dictate the most advantageous location on the vessel support structure 125 or the vessel 105.

Figure 9:
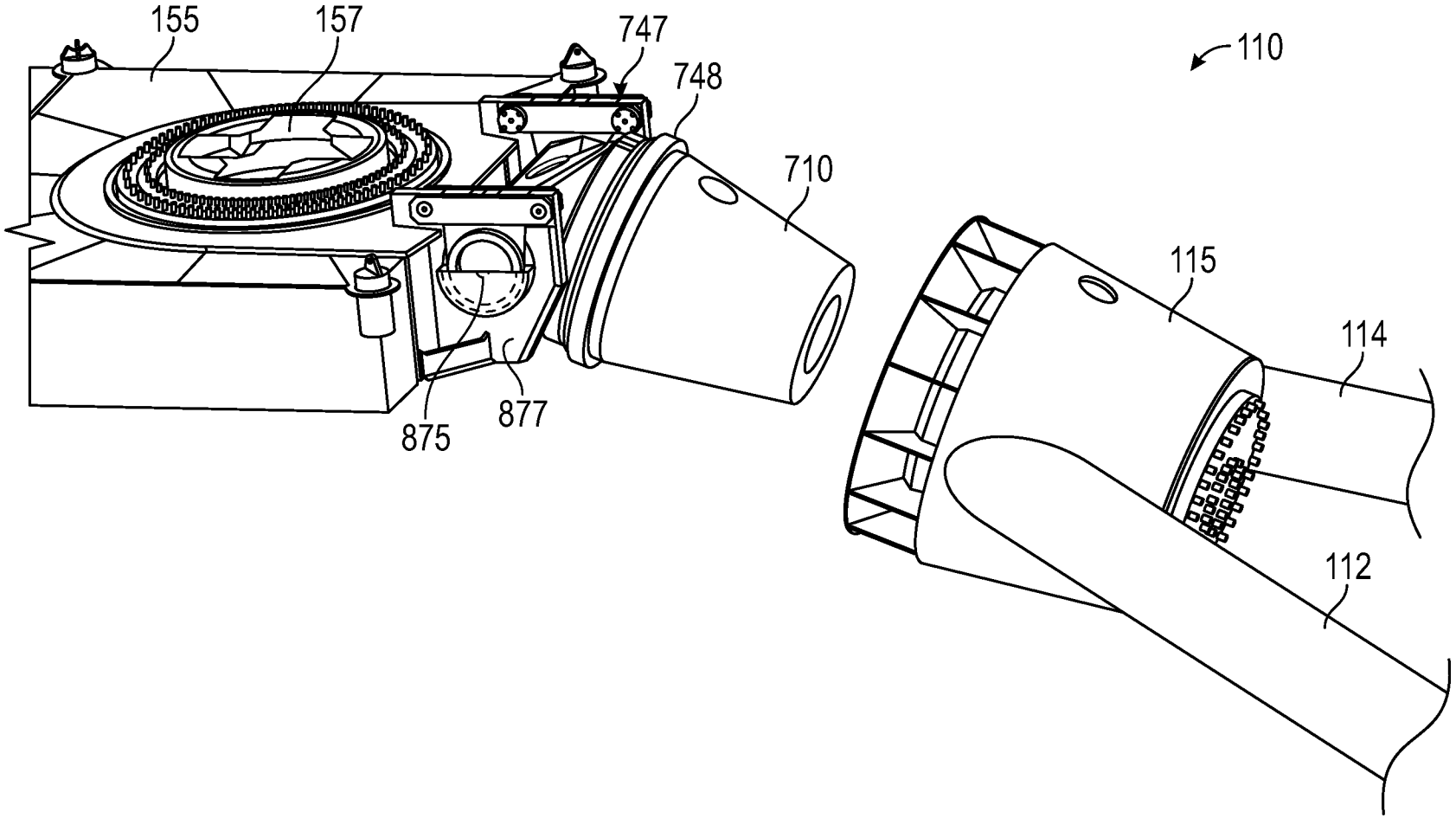
FIG. 9 depicts an illustrative schematic depicting an enlarged perspective view of the yoke head connector shown in FIG. 8 prior to connection to or after disconnection from the yoke head, according to one or more embodiments.

FIG. 9 depicts an illustrative schematic depicting an enlarged perspective view of the yoke head connector 710 shown in FIG. 8 prior to connection to or after disconnection from the yoke head 115, according to one or more embodiments. The yoke head connector 710 can be mounted to the turntable 155 using one or more joints or connectors 875 that allow for pivotal movement relative to the turntable 155. The yoke head connector 710 can be a trunnion mounted to the turntable 155. The trunnion connector 875 can extend outwardly from a trunnion housing 877. One or more roller bearings 157 can be used to allow the yoke head connector 710 to rotate relative to the turntable 155. One or more cylinders, not shown, can be hydraulic and/or pneumatic cylinders and can be attached to the trunnion housing 877 and to the turntable 155. The cylinders can be used to help move the yoke head connector 710 to facilitate the connection with the yoke head 115.

Figure 10:
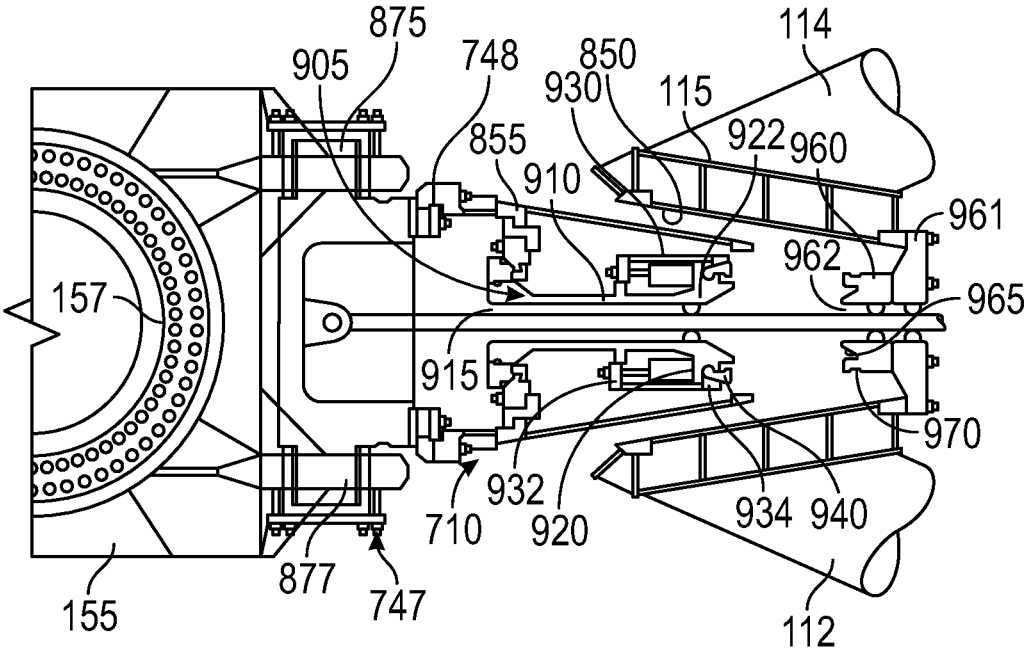
FIG. 10 depicts a partial cross section view of the working internals of the illustrative yoke head and the yoke head connector shown in FIG. 9 prior to connection, according to one or more embodiments.

FIG. 10 depicts a partial cross section view of the working internals of an illustrative version of the yoke head 115 and the yoke head connector 710 depicted in FIG. 9 prior to connection, according to one or more embodiments. In some embodiments, the yoke head 115 and the yoke head connector 710 form a disconnectable yoke head assembly. A suitable disconnectable yoke head assembly can include the yoke head assembly disclosed in U.S. Pat. No. 9,650,110. The yoke head connector 710 can be arranged and designed to cooperate with the yoke head 115. For example, both the yoke head 115 and the yoke head connector 710 can have conical or frusto-conical shaped surfaces: an inner surface 850 of the yoke head 115 (female) and an outer surface 855 of the yoke head connector 710 (male). These conical surfaces can provide a sliding surface to facilitate and guide the connection between the yoke head 115 and the yoke head connector 710. It should be understood that the yoke head 115 and the yoke head connector 710 can have any desired configuration with conical only being one example.

Figure 11:
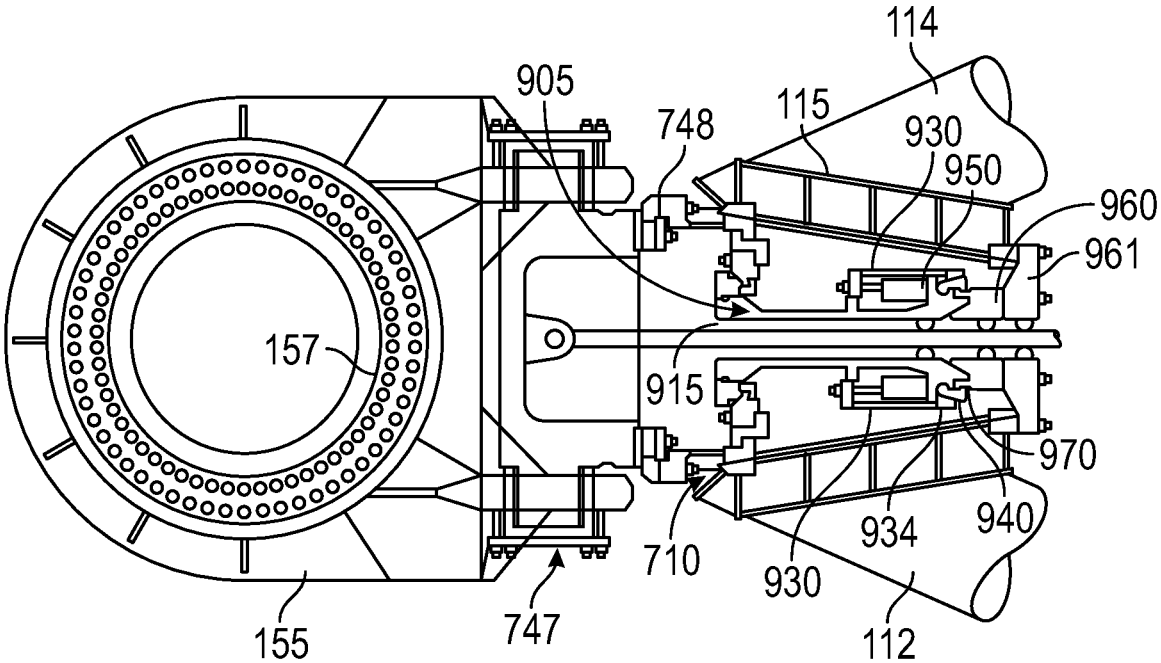
FIG. 11 depicts a partial cross section view of the working internals of the illustrative yoke head and yoke head connector shown in FIG. 9 after connection, according to one or more embodiments.

FIG. 11 depicts the partial cross section view of the working internals shown in FIG. 10 after connection, according to one or more embodiments. Referring to FIGS. 10 and 11, a hydraulic and/or pneumatic connection assembly 905 can be mounted within the yoke head connector 710. The connection assembly 905 can include a housing 910 having a bore 915 formed therethrough. The housing 910 can have an outwardly facing shoulder 920 and an extension or projection 922 formed thereon. One or more spaced apart fingers or collect segments 940 can be disposed about the housing 910 between the shoulder 920 and the projection 922. The outwardly facing shoulder 920 can be adjacent to and in contact with the fingers 940.

A movable sleeve 930 can be disposed about the housing 910. The movable sleeve 930 can have an inwardly directed flange 932 at one end and a band 934 at an opposite end. The band 934 can be adjacent to and configured to contact the one or more fingers 940. Linear movement of the sleeve 930 in a first direction (toward the vessel 105) allows the fingers 940 to rotate or pivot to a closed or locked position and linear movement of the sleeve 930 in an opposite, second direction (toward the mooring support tower 150) allows the fingers 940 to rotate or pivot about the outer surface of the housing 910 to an open or unlocked position.

One or more hydraulic and/or pneumatic cylinders or actuators 950 can used to move the sleeve 930 about the outer surface of the housing 910, allowing the fingers 940 to rotate or pivot open and close. The one or more actuators 950 can be positioned between and connected to the inwardly directed flange 932 of the movable sleeve 930 and the outwardly facing shoulder 920 of the stationary housing 910. When more than one actuator 950 are used, the actuators 950 can be controlled by a singular control to provide simultaneous operation and movement of the sleeve 930. The actuators 950 can be actuated from the mooring support structure 150 by accumulators and telemetry-controlled valves. Accumulators and telemetry-controlled valves are well known to those skilled in the art.

Still referring to FIGS. 10 and 11, the yoke head 115 can include a mating hub 960 for receiving and connecting to the connection assembly 905 of the yoke head connector 710. An annular adapter or member 961 can be disposed on the yoke head 115 and can be used to mount the mating hub 960. The mating hub 960 can also be an annular member having a bore 962 formed therethrough. The mating hub 960 can include a recessed section or receptacle 965 that can be sized and shaped to receive the projection 922 on the assembly housing 910. The mating hub 960 can also include a notched or profiled outer surface 970. The profiled outer surface 970 can be configured to engage and hold a similarly contoured profile that can be disposed on the fingers 940 such that when the fingers 940 rotate or pivot to their locked or closed position, the shaped profiles located on the fingers 940 and the outer surface 970 of the mating hub 960 matingly engage one other, as depicted in FIG. 10.

Referring to FIG. 11, as depicted the actuators 950 have moved the moveable sleeve 930 in the first direction toward the vessel 105, pushing the fingers 940 to rotate or pivot inwardly (toward the outer surface of the housing 910), such that the fingers 940 on the yoke head connector 710 engage the recessed profile 970 of the mating hub 960. In this closed position, the fingers 940 are generally parallel to the bore 915 of the housing 910 and overlap the profiled outer surface 970 on the mating hub 960, forming a lock and key engagement therebetween. Also, in this closed position, the projection 922 on the housing 910 can be located within the receptacle 965 of the mating hub 960. As such, the yoke head connector 710 can be fully engaged with the yoke head 115 and the vessel 105 can be securely moored to the mooring support structure 150. While engaged, the yoke head 115 cannot move or rotate independent of the yoke head connector 710.

Figure 12:
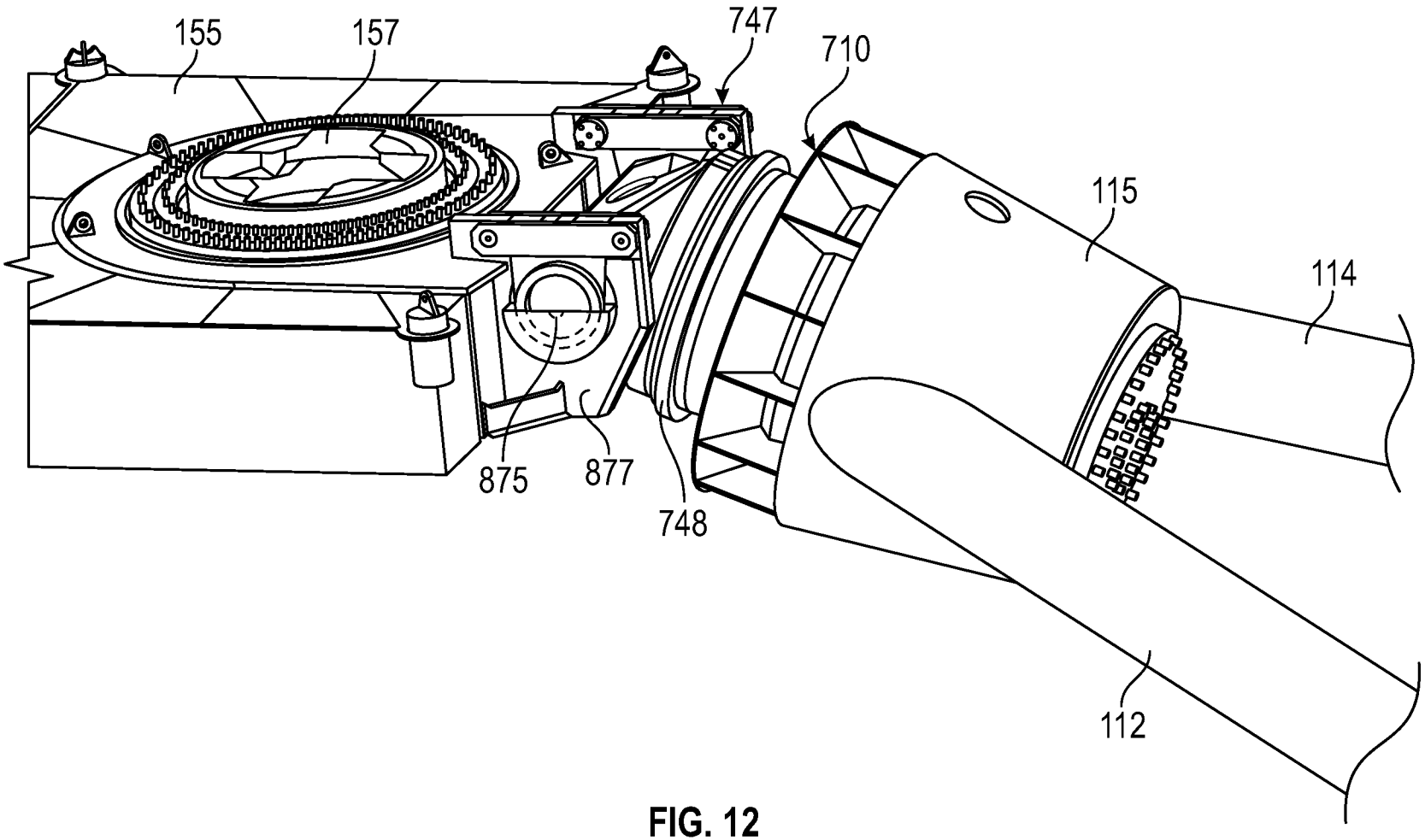
FIG. 12 depicts an enlarged perspective view of the yoke head and yoke head connector shown in FIG. 9 after being connected to one another, according to one or more embodiments.

FIG. 12 depicts an enlarged perspective view of the yoke head 115 and yoke head connector 710 shown in FIG. 9 after being connected to one another, according to one or more embodiments. Although not shown, a secondary mechanical lock in line with the actuators 950 can be used to keep the connection without the need of hydraulic and/or pneumatic pressure. A suitable secondary mechanical lock can be an interference sleeve lock, such as for example, the BEAR-LOC® locking device, manufactured by Wellman Dynamics Machining and Assembly Inc. of York, Pa.

It should be readily appreciated by those skilled in the art that the hydraulic connection assembly 905 and the mating hub 960, as provided herein, permit a quick disconnect under load and can be performed at sea, under harsh conditions. It should also be readily appreciated that the working internals and surfaces of the yoke head 115 and the yoke head connector 710 can be switched.

The vessel 105 may need to be disconnected from the mooring support structure 150 for various reasons, for example due to completion or cessation of operations or excessive environmental condition causing safety concerns. To disconnect the vessel 105 from the mooring support structure 150, the vessel's propulsion/engines can be engaged, such as using the stern thrust, prior to or after the disconnection of the yoke head 115. The thrust can be supplied by the vessel's main propulsion system, or using one or more external interventions, either exclusively or in combination with the vessel's main propulsion system, such as by one or more tugs, boats, ships or other vessel(s). The thrust can create a constant tension between the yoke head 115 and the yoke head connector 710 away from the mooring support structure 150, and should be sufficient to overcome any current or wave forces acting on the vessel 105.

With the vessel's thrust applied away from the mooring support structure 150 before or after the yoke head 115 is disconnected from the yoke head connector 710, the vessel can move away from the mooring support structure 150. The motion away from the mooring support structure 150 can separate the yoke head 115 from the yoke head connector 710. The yoke lift winch system 705 can control the up and down (or vertical) movement of the yoke 110.

Any back and forth movement (or horizontal movement) of the ballast tank 130 and hence the yoke head 115 can be controlled using the capabilities of the uni-directional passive surge damping system 135 and/or the yoke lift and cushion system 701 (with reference to FIG. 7). Applying the vessel's thrust away from the mooring support structure 150 before or after the yoke head 115 is disconnected from the yoke head connector 710 can also reduce the risk of banging or otherwise contacting the yoke 110 and/or yoke head 115 with the mooring support structure 200 or the vessel 105. This operation can be particularly useful in relatively harsh conditions, which presents a real danger of collision between the vessel 105 and the mooring support structure 150, and/or the yoke 110 or yoke head 115 and the mooring support structure 150.

One process for damping horizontal and vertical movement of a ballast tank in a yoke mooring system can include: (step 1210) connecting a first elongated tension member from a uni-directional passive surge damping system to a ballast tank in a yoke mooring system, the yoke mooring system comprising the ballast tank, a yoke, one or more extension arms connected at a first end to the ballast tank and connected at a second end to and suspended from a vessel; (step 1220) pressurizing one or more accumulators within the uni-directional passive surge damping system to set a tension on the elongated tension member, the uni-directional passive surge damping system comprising at least one cylinder with a piston disposed therein, the one or more accumulators in fluid communication with the at least one cylinder and an internal volume within the cylinder, one or more pulleys connected to at least the piston, and the elongated tension member routed around a portion of the one or more pulleys such that the tension on the elongated tension member is controlled as the piston extends from or retracts into the cylinder due to movement of the ballast tank; (optionally step 1230) adjusting the pressure in the one or more accumulators to maintain the tension on the elongated tension member; (optionally step 1240) adjusting the pressure in the one or more accumulators to extend or retract the piston; and (optionally step 1250) controlling vertical movement of the yoke using a yoke lift winch system connected to the yoke and located on a vessel support structure disposed on the vessel.

The present disclosure further relates to any one or more of the following numbered embodiments:

1. A damped yoke mooring system, comprising: a vessel support structure; at least one extension arm suspended from the vessel support structure; a ballast tank connected to the at least one extension arm, the ballast tank configured to move back and forth below the vessel support structure; a surge damping system disposed on the vessel, wherein the surge damping system comprises an elongated support connected to the ballast tank, and wherein the surge damping system is configured to tension the elongated support and dampen a movement of the ballast tank; and a yoke extending from and connected at a first end to the ballast tank, wherein the yoke comprises a yoke head disposed on a second end thereof.

2. The damped yoke mooring system of paragraph 1, wherein the surge damping system comprises one or more accumulator loaded cylinders and one or more pulleys, and wherein a portion of the elongated support is routed over a portion of the one or more pulleys.

3. The damped yoke mooring system of paragraph 1 or 2, wherein the surge damping system is disposed on the vessel support structure.

4. The damped yoke mooring system of any of paragraphs 1 to 3, wherein a first end of the elongated support is connected to the surge damping system and a second end of the elongated support is connected to the ballast tank.

5. The damped yoke mooring system of any of paragraphs 1 to 4, wherein the surge damping system comprises one or more wire line tensioners.

6. The damped yoke mooring system of any of paragraphs 1 to 5, wherein the surge damping system comprises one or more N-Line tensioners.

7. The damped yoke mooring system of any of paragraphs 1 to 6, wherein: the surge damping system comprises one or more cylinders and one or more accumulators; and the one or more accumulators is configured to pressurize the one or more cylinders to maintain the tension on the elongated support.

8. The damped yoke mooring system of any of paragraphs 1 to 7, wherein the surge damping system is hydraulic.

9. The damped yoke mooring system of any of paragraphs 1 to 8, wherein the surge damping system is pneumatic.

10. A system for mooring a vessel, comprising: a mooring support structure comprising: a base structure; a support column disposed on the base structure; and a turntable disposed on the support column, wherein the turntable is configured to at least partially rotate about the support column; a vessel support structure; at least one extension arm suspended from the vessel support structure; a ballast tank connected to the at least one extension arm, the ballast tank configured to move back and forth below the vessel support structure; a surge damping system disposed on the vessel, wherein the surge damping system comprises an elongated support connected to the ballast tank, and wherein the surge damping system is configured to tension the elongated support and dampen a movement of the ballast tank; and a yoke extending from and connected at a first end to the ballast tank, wherein the yoke comprises a yoke head disposed on a second end thereof, and wherein the yoke head is configured to connect to the turntable.

11. The mooring system of paragraph 10, wherein the surge damping system comprises one or more accumulator loaded cylinders and one or more pulleys; and wherein a portion of the elongated support is routed over a portion of the one or more pulleys.

12. The mooring system of paragraph 10 or 11, wherein the surge damping system is disposed on the vessel support structure.

13. The mooring system of any of paragraphs 10 to 12, wherein a first end of the elongated support is connected to the surge damping system and a second end of the elongated support is connected to the ballast tank.

14. The mooring system of any of paragraphs 10 to 13, wherein the surge damping system comprises one or more wire line tensioners.

15. The mooring system of any of paragraphs 10 to 14, wherein the surge damping system comprises one or more N-Line tensioners.

16. The mooring system of any of paragraphs 10 to 15, wherein the surge damping system comprises one or more cylinders and one or more accumulators for pressurizing the one or more cylinders and tensioning the elongated support.

17. A process for damping movement of a ballast tank in a yoke mooring system, comprising: connecting an elongated support from a surge damping system to a ballast tank in a yoke mooring system, the yoke mooring system comprising the ballast tank, a yoke, one or more extension arms connected at a first end to the ballast tank and connected at a second end to and suspended from a vessel support structure; and pressurizing an accumulator within the surge damping system to set a tension on the elongated support, the surge damping system comprising a cylinder with a piston disposed therein, the accumulator being in fluid communication with the cylinder and an internal volume within the cylinder, a pulley connected to the piston, and the elongated support routed over a portion of the pulley such that the tension on the elongated support is controlled as the piston extends from or retracts into the cylinder due to movement of the ballast tank.

18. The process of paragraph 17, further comprising adjusting the pressure in the one or more accumulators to maintain the tension on the elongated support.

19. The process of paragraph 17 or 18, further comprising adjusting the pressure in the one or more accumulators to extend or retract the piston.

20. The process of any of paragraphs 17 to 19, further comprising controlling movement of the yoke using a yoke lift winch system connected to the yoke and located on a vessel support structure disposed on the vessel.

21. A damped yoke mooring system, comprising: a vessel support structure disposed on a vessel, wherein a portion of the vessel support structure is cantilevered over a side of the vessel; at least one extension arm suspended from the cantilevered portion of the vessel support structure; a ballast tank connected to the at least one extension arm, the ballast tank configured to move back and forth below the vessel support structure; a surge damping system disposed on the vessel, wherein the surge damping system comprise a first elongated support connected to the ballast tank, and wherein the surge damping system is configured to tension the first elongated support and dampen a movement of the ballast tank; a yoke extending from and connected at a first end to the ballast tank, wherein the yoke comprises a yoke head disposed on a second end thereof; and a cushion cylinder comprising a second elongated support, wherein the cushion cylinder is disposed on the vessel support structure, and wherein the second elongated support is routed through at least a portion of the cushion cylinder and connected to the yoke to control a fall of the yoke during disconnection.

22. The damped yoke mooring system of paragraph 21, wherein the surge damping system comprises one or more accumulator loaded cylinders and one or more pulleys; and wherein a portion of the elongated support is routed over a portion of the one or more pulleys.

23. The damped yoke mooring system of paragraph 21 or 22, wherein the surge damping system is disposed on the vessel support structure.

24. The damped yoke mooring system of any of paragraphs 21 to 23, wherein a first end of the first elongated support is connected to the surge damping system and a second end of the first elongated support is connected to the ballast tank.

25. A system for mooring a vessel, comprising: a mooring support structure comprising: a base structure; and a turntable disposed on the base structure, wherein the turntable is configured to at least partially rotate about the base structure; a vessel support structure disposed on the vessel; at least one extension arm suspended from the vessel support structure; a ballast tank connected to the at least one extension arm, the ballast tank configured to move back and forth below the vessel support structure; a uni-directional passive surge damping system disposed on the vessel, wherein the uni-directional passive surge damping system comprises an elongated tension member connected to the ballast tank, and wherein the elongated tension member is configured to dampen a movement of the ballast tank by applying a tension to the ballast tank; and a yoke extending from and connected at a first end to the ballast tank, wherein the yoke comprises a yoke head disposed on a second end thereof, and wherein the yoke head is configured to connect to the turntable.

26. The system of paragraph 25, wherein the uni-directional passive surge damping system is configured to increase the tension applied to the ballast tank by the elongated member as a speed of the ballast tank moving away from the vessel increases.

27. The system of paragraph 25 or 26, wherein: the uni-directional passive surge damping system further comprises a hydraulic cylinder and an accumulator in fluid communication with one another, the accumulator is configured to apply a pressure to the hydraulic cylinder, when the pressure is applied to the hydraulic cylinder, the hydraulic cylinder is configured to apply a force to the elongated tension member, and at least a portion of the force is transferred to the ballast tank as the tension applied by the elongated tension member.

28. The system of paragraph 27, wherein: the uni-directional passive surge damping system further comprises a manifold block, the manifold block is disposed between the hydraulic cylinder and the accumulator, the manifold block is in fluid communication with the hydraulic cylinder and the accumulator, the manifold block is configured to restrict the flow of a fluid from the hydraulic cylinder into the accumulator such that the pressure in the hydraulic cylinder increases as the speed of the ballast tank increases in a direction away from the vessel, and the increase in pressure in the hydraulic cylinder increases the force applied to the elongated tension member.

29. The system of paragraph 28, wherein a magnitude of the force applied to the elongated tension member by the hydraulic cylinder increases as a speed of the ballast tank increases in a direction away from the vessel.

30. The system of paragraph 28 or 29, wherein the manifold block comprises a check valve and a pressure reducing fitting.

31. The system of any of paragraphs 25 to 30, wherein the uni-directional passive surge damping system further comprises a heat exchanger configured to remove heat generated by the uni-directional passive surge damping system when the uni-directional passive surge damping system dampens the movement of the ballast tank.

32. The system of any of paragraphs 25 to 31, wherein the uni-directional passive surge damping system further comprises a pulley, and wherein a portion of the elongated tension member is routed around a portion of the pulley.

33. The system of any of paragraphs 25 to 32, wherein the uni-directional passive surge damping system is at least partially disposed on the vessel support structure.

34. The system of any of paragraphs 25 to 33, wherein the elongated tension member comprises a cable or wire rope.

35. The system of paragraph 34, wherein the elongated tension member is a cable or wire rope that is configured to only support a tension.

36. The system of paragraph 34 or 35, wherein the cable or wire rope is in a fiber core, an independent wire rope core, or a wire strand core configuration.

37. The system of any of paragraphs 34 to 36, wherein the cable or wire rope is constructed of stainless steel, galvanized steel, or carbon steel.

38. The system of any of paragraphs 25 to 33, wherein in the elongated tension member is a rope constructed of a polypropylene, a nylon, a polyester, a polyethylene, an aramids, an acrylic, or any combination thereof.

39. The system of any of paragraphs 25 to 38, wherein the uni-directional passive surge damping system comprises a wire line tensioner.

40. The system of any of paragraphs 25 to 38, wherein the uni-directional passive surge damping system comprises a N-Line tensioner.

41. The system of any of paragraphs 25 to 38, wherein the uni-directional passive surge damping system comprises a wire line tensioner and a N-Line tensioner.

42. The system of any of paragraphs 25 to 41, wherein the uni-directional passive surge damping system is free of any active control system.

43. The system of any of paragraphs 25, 26, and 31 to 42, wherein: the uni-directional passive surge damping system further comprises a hydraulic cylinder, a manifold block, and an accumulator in fluid communication with one another, the manifold block is configured to apply a pressure to the hydraulic cylinder by restricting fluid flow from the hydraulic cylinder into the accumulator, when the pressure is applied to the hydraulic cylinder the hydraulic cylinder is configured to apply a force to the elongated tension member, at least a portion of the force is transferred to the ballast tank as the tension applied by the elongated tension member, and the manifold block is configured to allow fluid to flow from the accumulator into the hydraulic cylinder to apply a force to the elongated tension member that is not dependent on a speed of the ballast tank as the ballast tank moves toward the vessel.

44. The system of any of paragraphs 25 to 43, wherein uni-directional passive surge damping system is configured to not increase the tension applied to the ballast tank by the elongated member as a speed of the ballast tank moving toward the vessel increases.

45. The system of any of paragraphs 25, 26, and 31 to 42, wherein: the uni-directional passive surge damping system further comprises a heat exchanger configured to remove heat generated by the uni-directional passive surge damping system when the uni-directional passive surge damping system dampens the movement of the ballast tank, the uni-directional passive surge damping system further comprises a hydraulic cylinder, a manifold block, and an accumulator in fluid communication with one another, the manifold block is configured to apply a pressure to the hydraulic cylinder by restricting fluid flow from the hydraulic cylinder into the accumulator as the speed of the ballast tank increases in a direction away from the vessel, when the pressure is applied to the hydraulic cylinder the uni-directional passive surge damping system is configured to apply a force to the elongated tension member, at least a portion of the force is transferred to the ballast tank as the tension applied by the elongated tension member, the manifold block is configured to allow fluid to flow from the accumulator into the hydraulic cylinder to apply a force to the elongated tension member that is not dependent on a speed of the ballast tank as the ballast tank moves toward the vessel, the uni-directional passive surge damping system further comprises a pulley, wherein a portion of the elongated tension member is routed over a portion of the pulley, the elongated tension member comprises a cable or wire rope, and a first end of the elongated tension member is connected to the ballast tank and a second end of the elongated tension member is connected to the vessel.

46. The system of any of paragraphs 25 to 45, wherein the turntable comprises a yoke head connector disposed thereon, wherein at least one of the yoke head and the yoke head connector is in communication with at least one actuator, and wherein the at least one actuator is configured to lock the yoke head and the yoke head connector in mating engagement and configured to unlock and allow the engaged yoke head and yoke head connector to disengage from one another.

47. The system of any of paragraphs 25 to 46, further comprising a cushion cylinder comprising a second elongated tension member, wherein the cushion cylinder is disposed on the vessel support structure, and wherein the second elongated tension member is routed around at least a portion of the cushion cylinder and connected to the yoke to control a fall of the yoke during disconnection.

48. The system of paragraph 47, wherein the yoke head is connected to the turntable, and wherein a length of the second elongated tension member is configured to prevent the yoke head from entering water the vessel is floating on a surface of when the yoke head is disconnected from the turntable.

49. A process for mooring a floating vessel to a mooring support structure at sea, comprising: providing a floating vessel comprising: a vessel support structure disposed on the vessel; at least one extension arm suspended from the vessel support structure; a ballast tank connected to the at least one extension arm, the ballast tank configured to move back and forth below the vessel support structure; a uni-directional passive surge damping system disposed on the vessel, wherein the uni-directional passive surge damping system comprises an elongated tension member connected to the ballast tank; a yoke extending from and connected at a first end to the ballast tank, wherein the yoke comprises a yoke head disposed on a second end thereof, and wherein the yoke head is configured to connect to a turntable disposed on the mooring support structure; locating the vessel close to the mooring support structure, the mooring support structure comprising a base structure, wherein the turntable is disposed on the base structure, and wherein the turntable is configured to at least partially rotate about the base structure; connecting the yoke head to the turntable; and damping a movement of the ballast tank by applying a tension to the ballast tank with the elongated tension member as the ballast tank moves away from the vessel.

50. The process of paragraph 49, wherein the tension applied to the ballast tank by the elongated member increases as a speed of the ballast tank moving away from the vessel increases.

51. The process of paragraph 49 or 50, wherein the tension applied by the elongated member to the ballast tank when the ballast tank moves toward the vessel does not increase as a speed of the ballast tank moving toward the vessel increases.

52. The process of any of paragraphs 49 to 51, wherein the uni-directional passive surge damping system further comprises a hydraulic cylinder, a manifold block, and an accumulator in fluid communication with one another, the process, the process further comprising: applying a pressure to the hydraulic cylinder by restricting a flow of fluid from the hydraulic cylinder into the accumulator, wherein the manifold restricts the flow of the fluid, and wherein, when the pressure is applied to the hydraulic cylinder, the hydraulic cylinder applies a force to the elongated tension member, and transferring at least a portion of the force to the ballast tank as the tension applied by the elongated tension member.

53. The process of paragraph 52, wherein the manifold block comprises a check valve and a pressure reducing fitting, wherein the fluid flows through the pressure reducing fitting when the ballast tank moves away from the vessel, and wherein the fluid flows through the check valve when the ballast tank moves toward the vessel.

54. The process of any of paragraphs 49 to 53, further comprising removing heat generated by the uni-directional passive surge damping system when the uni-directional passive surge damping system dampens the movement of the ballast tank.

55. The process of any of paragraphs 49 to 54, wherein the turntable comprises a yoke head connector disposed thereon, wherein connecting the yoke head to the turn table comprises actuating at least one actuator in communication with the yoke head or the yoke head connector to lock the yoke head and the yoke head connector in mating engagement.

56. The process of any of paragraphs 49 to 55, wherein the vessel further comprises a cushion cylinder comprising a second elongated tension member, wherein the cushion cylinder is disposed on the vessel, and wherein the second elongated tension member is routed around at least a portion of the cushion cylinder and connected to the yoke to control a fall of the yoke during disconnection, the process further comprising disconnecting the yoke head from the turntable; and slowing a fall of the yoke with the cushion cylinder upon disconnection of the yoke head from the turntable.

57. The process of paragraph 56, wherein a length of the second elongated tension member is configured to prevent the yoke head from entering water the vessel is floating on a surface of when the yoke head is disconnected from the turntable.

58. The process of any of paragraphs 49 to 57, wherein the uni-directional passive surge damping system further comprises a pulley, and wherein a portion of the elongated tension member is routed around a portion of the pulley.

59. The process of any of paragraphs 49 to 58, wherein the uni-directional passive surge damping system is at least partially disposed on the vessel support structure.

60. The process of any of paragraphs 49 to 59, wherein the elongated tension member comprises a cable or wire rope.

61. The process of any of paragraphs 49 to 60, wherein the elongated tension member is a cable or wire rope that is configured to only support a tension.

62. The process of paragraph 60 or 61, wherein the cable or wire rope is in a fiber core, an independent wire rope core, or a wire strand core configuration.

63. The process of any of paragraphs 60 to 62, wherein the cable or wire rope is constructed of stainless steel, galvanized steel, or carbon steel.

64. The process of any of paragraphs 49 to 59, wherein in the elongated tension member is a rope constructed of a polypropylene, a nylon, a polyester, a polyethylene, an aramids, an acrylic, or any combination thereof.

65. The process of any of paragraphs 49 to 64, wherein the uni-directional passive surge damping system comprises a wire line tensioner.

66. The process of any of paragraphs 49 to 64, wherein the uni-directional passive surge damping system comprises a N-Line tensioner.

67. The process of any of paragraphs 49 to 64, wherein the uni-directional passive surge damping system comprises a wire line tensioner and a N-Line tensioner.

68. The process of any of paragraphs 49 to 67, wherein the uni-directional passive surge damping system is free of any active control system.

69. The system or process of any of paragraphs 25 to 68, wherein a magnitude of the tension applied to the ballast tank by the elongated tension member increases as a speed of the ballast tank moving away from the vessel increases.

70. The system or process of any of paragraphs 25 to 69, wherein a magnitude of the tension applied to the ballast tank by the elongated tension member remains substantially constant as a speed of the ballast tank moving toward the vessel increases.

71. The system or process of any of paragraphs 25 to 70, wherein a magnitude of the tension applied to the ballast tank by the elongated tension member as the ballast tank moves away from the vessel is greater than a magnitude of the tension applied to the ballast tank by the elongated member as the ballast tank moves toward the vessel.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A system for mooring a vessel, comprising:

a mooring support structure comprising:

a base structure; and a turntable disposed on the base structure, wherein the turntable is configured to at least partially rotate about the base structure;

a vessel support structure disposed on the vessel;

at least one extension arm suspended from the vessel support structure;

a ballast tank connected to the at least one extension arm, the ballast tank configured to move back and forth below the vessel support structure;

a uni-directional passive surge damping system disposed on the vessel, the uni-directional passive surge damping system comprising:

an elongated tension member connected to the ballast tank, wherein the elongated tension member is configured to dampen a movement of the ballast tank by applying a tension to the ballast tank; and a hydraulic cylinder, an accumulator, and a manifold block disposed between the hydraulic cylinder and the accumulator, wherein:

the hydraulic cylinder, the accumulator, and the manifold block are in fluid communication with one another, the accumulator is configured to apply a pressure to the hydraulic cylinder, when the pressure is applied to the hydraulic cylinder, the hydraulic cylinder is configured to apply a force to the elongated tension member, when the force is applied to the elongated tension member, at least a portion of the force is transferred to the ballast tank as the tension applied by the elongated tension member to dampen the movement of the ballast tank, the manifold block comprises a check valve and a pressure reducing fitting, the manifold block is configured to restrict the flow of a fluid from the hydraulic cylinder into the accumulator such that the pressure in the hydraulic cylinder increases as a speed of the ballast tank increases in a direction away from the vessel, and the increase in pressure in the hydraulic cylinder increases the force applied to the elongated tension member; and a yoke extending from and connected at a first end to the ballast tank, wherein the yoke comprises a yoke head disposed on a second end thereof, and wherein the yoke head is configured to connect to the turntable.

2. The system of claim 1, wherein the uni-directional passive surge damping system is configured to not increase the tension applied to the ballast tank by the elongated member as a speed of the ballast tank moving toward the vessel increases.

3. The system of claim 1, wherein the uni-directional passive surge damping system further comprises a heat exchanger configured to remove heat generated by the uni-directional passive surge damping system when the uni-directional passive surge damping system dampens the movement of the ballast tank, and wherein the heat exchanger comprises a liquid cooled open loop heat exchanger, an air cooled closed loop heat exchanger, or a liquid cooled closed loop heat exchanger.

4. The system of claim 1, wherein the uni-directional passive surge damping system further comprises a pulley, and wherein a portion of the elongated tension member is routed around a portion of the pulley.

5. The system of claim 1, wherein the elongated tension member comprises a cable or wire rope.

6. The system of claim 1, wherein the uni-directional passive surge damping system comprises a wire line tensioner or a N-Line tensioner.

7. The system of claim 1, wherein the uni-directional passive surge damping system is free of any active control system.

8. The system of claim 1, wherein the manifold block is configured to allow fluid to flow from the accumulator into the hydraulic cylinder to apply the force to the elongated tension member, wherein the force is not dependent on a speed of the ballast tank as the ballast tank moves toward the vessel.

9. The system of claim 8, wherein the uni-directional passive surge damping system is configured to not increase the tension applied to the ballast tank by the elongated member as a speed of the ballast tank moving toward the vessel increases.

10. The system of claim 1, wherein:

the manifold block is configured to allow fluid to flow from the accumulator into the hydraulic cylinder to apply the force to the elongated tension member, wherein the force is not dependent on a speed of the ballast tank as the ballast tank moves toward the vessel, the uni-directional passive surge damping system further comprises a pulley, wherein a portion of the elongated tension member is routed over a portion of the pulley, the elongated tension member comprises a cable or wire rope, and a first end of the elongated tension member is connected to the ballast tank and a second end of the elongated tension member is connected to the vessel.

11. The system of claim 1, wherein the turntable comprises a yoke head connector disposed thereon, wherein at least one of the yoke head and the yoke head connector is in communication with at least one actuator, and wherein the at least one actuator is configured to lock the yoke head and the yoke head connector in mating engagement and configured to unlock and allow the engaged yoke head and yoke head connector to disengage from one another.

12. A process for damping a motion of a floating vessel moored to a mooring support structure at sea, wherein the floating vessel comprises:

a vessel support structure disposed on the vessel;

at least one extension arm suspended from the vessel support structure;

a ballast tank connected to the at least one extension arm, the ballast tank configured to move back and forth below the vessel support structure;

a uni-directional passive surge damping system disposed on the vessel, wherein the uni-directional passive surge damping system comprises:

an elongated tension member configured to be connected to the ballast tank, and a hydraulic cylinder, a manifold block, and an accumulator in fluid communication with one another, wherein the manifold block comprises a check valve and a pressure reducing fitting; and a yoke extending from and connected at a first end to the ballast tank, wherein the yoke comprises a yoke head disposed on a second end thereof, and wherein the yoke head is connected to a turntable disposed on the mooring support structure; and wherein the mooring support structure comprises a base structure, wherein the turntable is disposed on the base structure, and wherein the turntable is configured to at least partially rotate about the base structure; the process comprising:

connecting the elongated tension member to the ballast tank; and damping a movement of the ballast tank by applying a tension to the ballast tank with the elongated tension member as the ballast tank moves away from the vessel, wherein damping the movement of the ballast tank comprises:

applying a pressure to the hydraulic cylinder by restricting a flow of a fluid from the hydraulic cylinder into the accumulator, wherein:

the manifold restricts the flow of the fluid, the fluid flows through the pressure reducing fitting when the ballast tank moves away from the vessel, the fluid flows through the check valve when the ballast tank moves toward the vessel, when the pressure is applied to the hydraulic cylinder, the hydraulic cylinder applies a force to the elongated tension member, and at least a portion of the force is transferred to the ballast tank as the tension applied by the elongated tension member.

13. The process of claim 12, wherein the tension applied to the ballast tank by the elongated member increases as a speed of the ballast tank moving away from the vessel increases, and wherein the tension applied by the elongated member to the ballast tank when the ballast tank moves toward the vessel does not increase as a speed of the ballast tank moving toward the vessel increases.

14. The process of claim 12, further comprising removing heat generated by the uni-directional passive surge damping system with a heat exchanger when the uni-directional passive surge damping system dampens the movement of the ballast tank, wherein the heat exchanger comprises a liquid cooled open loop heat exchanger, an air cooled closed loop heat exchanger, or a liquid cooled closed loop heat exchanger.

15. The process of claim 12, wherein the turntable comprises a yoke head connector disposed thereon, wherein connecting the yoke head to the turntable comprises actuating at least one actuator in communication with the yoke head or the yoke head connector to lock the yoke head and the yoke head connector in mating engagement.

* * * * *